US006959163B2

(12) United States Patent
Nishiyama

(10) Patent No.: US 6,959,163 B2
(45) Date of Patent: Oct. 25, 2005

(54) DEVELOPING DEVICE FEATURING THREE MAGNETIC POLES FOR GENERATING THREE MAGNETIC FORCES

(75) Inventor: Kazushige Nishiyama, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 61 days.

(21) Appl. No.: 10/162,589

(22) Filed: Jun. 6, 2002

(65) Prior Publication Data

US 2004/0076454 A1 Apr. 22, 2004

(30) Foreign Application Priority Data

Jun. 7, 2001 (JP) ..... 2001-171978
Jun. 15, 2001 (JP) ..... 2001-181434

(51) Int. Cl.[7] ..... G03G 15/09
(52) U.S. Cl. ..... 399/269
(58) Field of Search ..... 399/267, 269, 399/274, 275, 277, 282, 284

(56) References Cited

U.S. PATENT DOCUMENTS

| | | | | | |
|---|---|---|---|---|---|
| 3,977,361 | A | * | 8/1976 | Nagashima et al. | 399/267 |
| 4,008,686 | A | * | 2/1977 | Katakura et al. | 399/269 |
| 4,266,868 | A | * | 5/1981 | Bresina et al. | 399/269 |
| 4,436,055 | A | * | 3/1984 | Yamashita et al. | 399/269 |
| 5,911,098 | A | * | 6/1999 | Gyotoku et al. | 399/269 |
| 5,987,288 | A | * | 11/1999 | Mori et al. | 399/269 |
| 6,125,255 | A | * | 9/2000 | Litman et al. | 399/277 |
| 6,235,441 | B1 | * | 5/2001 | Tanikawa et al. | |
| 6,269,235 | B1 | | 7/2001 | Nishiyama | 399/267 |
| 6,397,031 | B1 | * | 5/2002 | Itoh | 399/269 |
| 6,408,150 | B1 | | 6/2002 | Nishiyama | 399/104 |
| 2002/0054773 | A1 | * | 5/2002 | Shirai | 399/269 |

FOREIGN PATENT DOCUMENTS

| | | |
|---|---|---|
| JP | 2-188778 | 7/1990 |
| JP | 3-5579 | 1/1991 |
| JP | 3-36570 | 2/1991 |
| JP | 2-204084 | 9/1991 |
| JP | 9-80919 | 3/1997 |
| JP | 3017514 | 12/1999 |

* cited by examiner

*Primary Examiner*—Susan Lee
(74) *Attorney, Agent, or Firm*—Fitzpatrick, Cella, Harper & Scinto

(57) ABSTRACT

A developing device includes a developing container for accommodating a magnetic developer containing magnetic toner. First and second developer carrying members carry the developer from inside of the developing container toward an image bearing member by rotations thereof in the same rotational directions. The developer is fed by the first developer carrying member to and then is fed by the second developer carrying member to a latent image formed by the image bearing member. First and second magnetic field generation members are provided in the first and second developer carrying member fields, wherein the first magnetic field has a first magnetic pole disposed at a position substantially opposed to the image bearing member, and a second magnetic pole disposed at a position substantially opposite the second developer carrying member and having a polarity opposite the first magnetic pole. The second magnetic field generation member has a third magnetic pole disposed at a position substantially opposite the first developer carrying member and having the same polarity as the first magnetic pole. Magnetic forces A, B and C provided by the first magnetic pole, the second magnetic pole and the third magnetic pole, respectively satisfy: |A|>|B|>|C|.

8 Claims, 13 Drawing Sheets

DEVELOPING DEVICE FEATURING THREE MAGNETIC POLES FOR GENERATING THREE MAGNETIC FORCES

FIELD OF THE INVENTION AND RELATED ART

The present invention relates to a developing apparatus employed by a copying machine, a printer, a facsimile, or the like, which employs an electrophotographic method or the like.

It has been known that in an image forming apparatus employing an electrophotographic method or the like, prints or copies are formed through the following processes: the peripheral surface of a latent image bearing member is uniformly charged; an electrostatic latent image is formed on the uniformly charged peripheral surface of the latent image bearing member by exposing the surface in an analog fashion, or digitally exposing the surface with the use of a semiconductor laser, an LED, or the like; the electrostatic latent image is developed into a developer image, that is, a visible image, by a developing apparatus; the visible image, or the developer image, is transferred onto a transfer medium; the developer image is fixed to the transfer medium by a fixing apparatus after the transfer medium is separated from the latent image bearing member; and the transfer medium, bearing the fixed developer image, is outputted from the main assembly of the image forming apparatus.

First, referring to FIG. 12, the operation of a typical image forming apparatus heretofore in use will be described.

The image forming apparatus in FIG. 12 has a photoconductive drum 101, as a latent image bearing member, which is provided with a photoconductive layer, for example, a layer of organic photoconductor, amorphous silicon, or the like, and is rotated in the direction indicated by an arrow mark A.

In this type of image forming apparatus, first, the peripheral surface of the photoconductive drum 101 is uniformly charged by a primary charging device 103, to +500 V, for example.

Next, the uniformly charged peripheral surface of the photoconductive drum 101 is exposed to an image exposing light 112 modulated with image formation signal data to attenuate the surface potential of the exposed portions of the peripheral surface of the photoconductive drum 101 to −200 V, for example. As a result, a latent image in accordance with the image formation signals is formed on the peripheral surface of the photoconductive drum 101. As the source of the image exposing light 112, a semiconductor laser or an LED array is used.

Next, the above described latent image is developed into a toner image, that is, a visible with the use of a developing apparatus 102, shown in FIG. 13, which uses single-component developer. A developing apparatus which uses single-component developer is simple and does not require exchange or replenishment of carrier or the like, being therefore, highly durable and long in service life. One of the developing methods which employs single-component developer is a jumping developing method which uses single-component magnetic toner. The developing apparatus 102 has an upstream development sleeve 120, as a developer bearing member, in the hollow of which a magnet or the like is stationarily placed so that its magnetic poles are positioned as shown in FIG. 14. The developing apparatus 102 uses black toner, which usually is chargeable to negative polarity. During a development period, a DC bias voltage of approximately −500 V is applied as development bias voltage to the upstream development sleeve 120 of the developing apparatus 102. As a result, the latent image on the peripheral surface of the photoconductive drum 101 is reversely developed.

In the case of a durable image forming apparatus, for example, a high speed image forming apparatus, the external diameter of the photoconductive drum is too large to rely on the curvature of the photoconductive drum for the separation of a transfer medium from the photoconductive drum. Therefore, prior to the transfer process, the portion of the photoconductive drum 101, bearing the above described toner image, is preprocessed by a post-charger 110, that is, a charging means, (which ordinarily is a DC or AC based corona discharger, which sometimes is used in combination with photo-discharger or the like).

Thereafter, the toner image on the peripheral surface of the photoconductive drum 101 is transferred by a transfer charger 104, onto the transfer medium delivered to the interface between the photoconductive drum 101 and transfer charger 104.

After the transfer of the toner image onto the transfer medium by the transfer charger 104, the transfer medium is separated from the peripheral surface of the photoconductive drum 101 by a separation charger 105, and is then conveyed to the fixing apparatus 107, which fixes the toner image to the transfer medium, effecting a permanent image.

Also after the transfer of the toner image, the photoconductive drum 101 is cleaned by a cleaning apparatus 106; the residual toner particles, that is, the toner particles which were not consumed for development and remain on the peripheral surface of the photoconductive drum 101, are removed by the cleaning apparatus 106, to prepare the photoconductive drum 101 for the next image formation.

In order to increase the speed of an image forming apparatus, various modifications have been made to the conventional developing apparatus. For example, Japanese Laid-open Patent Application 3-204084 discloses a modification in which a developing apparatus which uses a two-component magnetic brush is provided with a plurality of development sleeves as a developer bearing member. Japanese Laid-open Patent Application 2-188778 discloses another modification in which a developing apparatus is provided with a plurality of development sleeves as a developer bearing member, and in which in order to assure that toner is uniformly supplied from the development sleeves to the photoconductive drum, the distance between the development sleeve on the downstream side, in terms of the rotational direction of the photoconductive drum, and the photoconductive drum, is made smaller than the distance between the development sleeve on the upstream side and the photoconductive drum.

Japanese Patent Application Publication 3-5579 discloses a developing apparatus equipped with a plurality of developing sleeves reduced in size to reduce the size of the developing apparatus in order to reduce image forming apparatus size.

Further, Japanese Laid-open Patent Application 9-80919 and Japanese Patent 3017514 offer proposals regarding the magnetic force of the development sleeves of a developing apparatus, such as those described above, which uses two-component developer for development.

However, because the upstream developer bearing member in terms of the rotational direction of the latent image bearing member was placed close enough to enable the downstream developer bearing member to regulate the amount of the developer on the downstream developer bearing member to a predetermined amount, a development apparatus such as those described above, equipped with a plurality of development sleeves, suffered from the following problem: Single-component magnetic developer was difficult to coat on the developer bearing member as uniformly as two-component developer, although such a structural arrangement made it possible to reduce developing apparatus size, and hence, image forming apparatus size. Therefore, a developing apparatus, such as the above described ones, which is equipped with a plurality of development sleeves, and uses single-component magnetic developer has not been put to practical use, nor has been presented in the academic societies.

A developing apparatus to which developer is supplied as necessary, instead of relying on the so-called cartridge system, and a developing system which uses a plurality of developer bearing members, are suitable for a high speed apparatus. However, they are particularly difficult to realize, because a developing apparatus for a high speed apparatus must be superior in durability and safety.

SUMMARY OF THE INVENTION

The primary object of the present invention is to provide a developing apparatus, the first developer bearing member of which is superior in developer conveyance.

Another object of the present invention is to provide a developing apparatus, the second developer bearing member of which is superior in developer conveyance.

These and other objects, features, and advantages of the present invention will become more apparent upon consideration of the following description of the preferred embodiments of the present invention, taken in conjunction with the accompanying drawings.

DESCRIPTION OF THE PREFERRED EMBODIMENTS

Hereinafter, the preferred embodiments of the present invention will be described with reference to the appended drawings.

Embodiment 1

First, the general structure of the image forming apparatus in this embodiment will be described.

Figure 1:
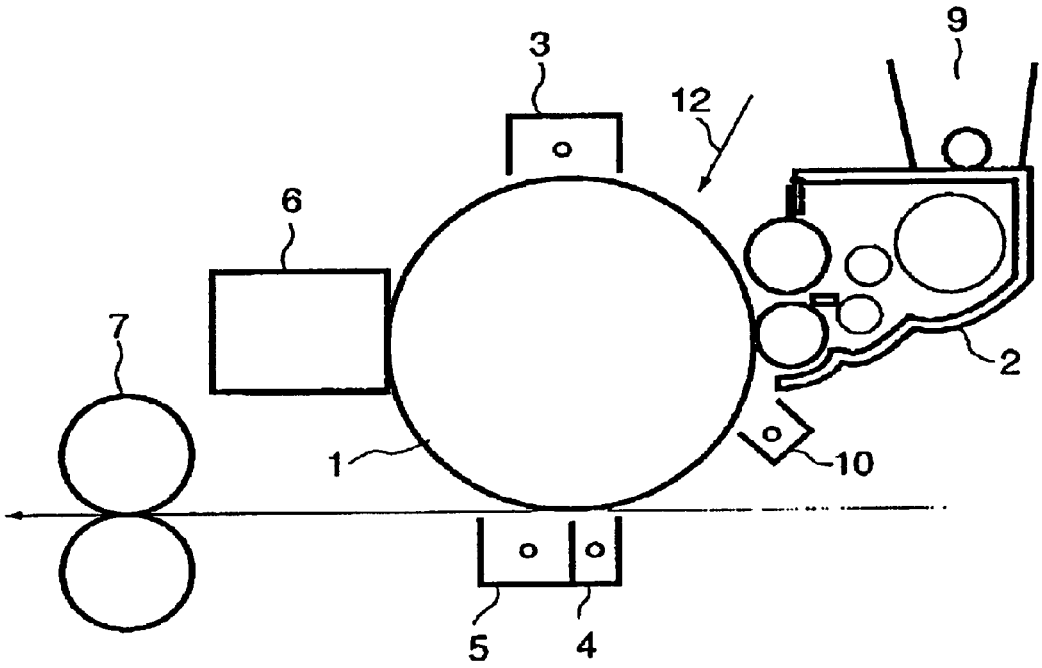
FIG. 1 is a schematic sectional view of an image forming apparatus, for showing the general structure thereof.

FIG. 1 shows the general structure of the image forming apparatus in this embodiment.

The image forming apparatus in this embodiment is a black-and-white digital copying machine which is 470 mm/sec in process speed and produces 90 copies per minutes. It comprises a photoconductive drum 1 as a latent image bearing member, which is an amorphous silicon type photoconductive drum having a diameter of 108 mm.

Referring to FIG. 1, in the image forming apparatus, the peripheral surface of the photoconductive drum 1 as a latent image bearing member is uniformly charged by a primary charger 3 to a potential level of +450 V, for example, and then, is exposed to a beam 12 of image exposure light at a resolution of 600 psi. The exposure beam 12 is a laser beam modulated with image formation signals, and its source is a semiconductor laser. The exposure beam 12 is deflected by a polygonal mirror (unshown) being revolved at a predetermined rate by a motor (unshown), sent through a focal lens (unshown), and deflected by a deflector mirror (unshown), so that it scans the peripheral surface of the photoconductive drum 1, attenuating the surface potential of the exposed areas of the peripheral surface of the photoconductive drum 1 to +50 V, for example. As a result, a latent image reflecting the image formation signals is formed on the peripheral surface of the photoconductive drum 1. The wavelength of the laser beam in this embodiment is 680 mm.

Figure 2:
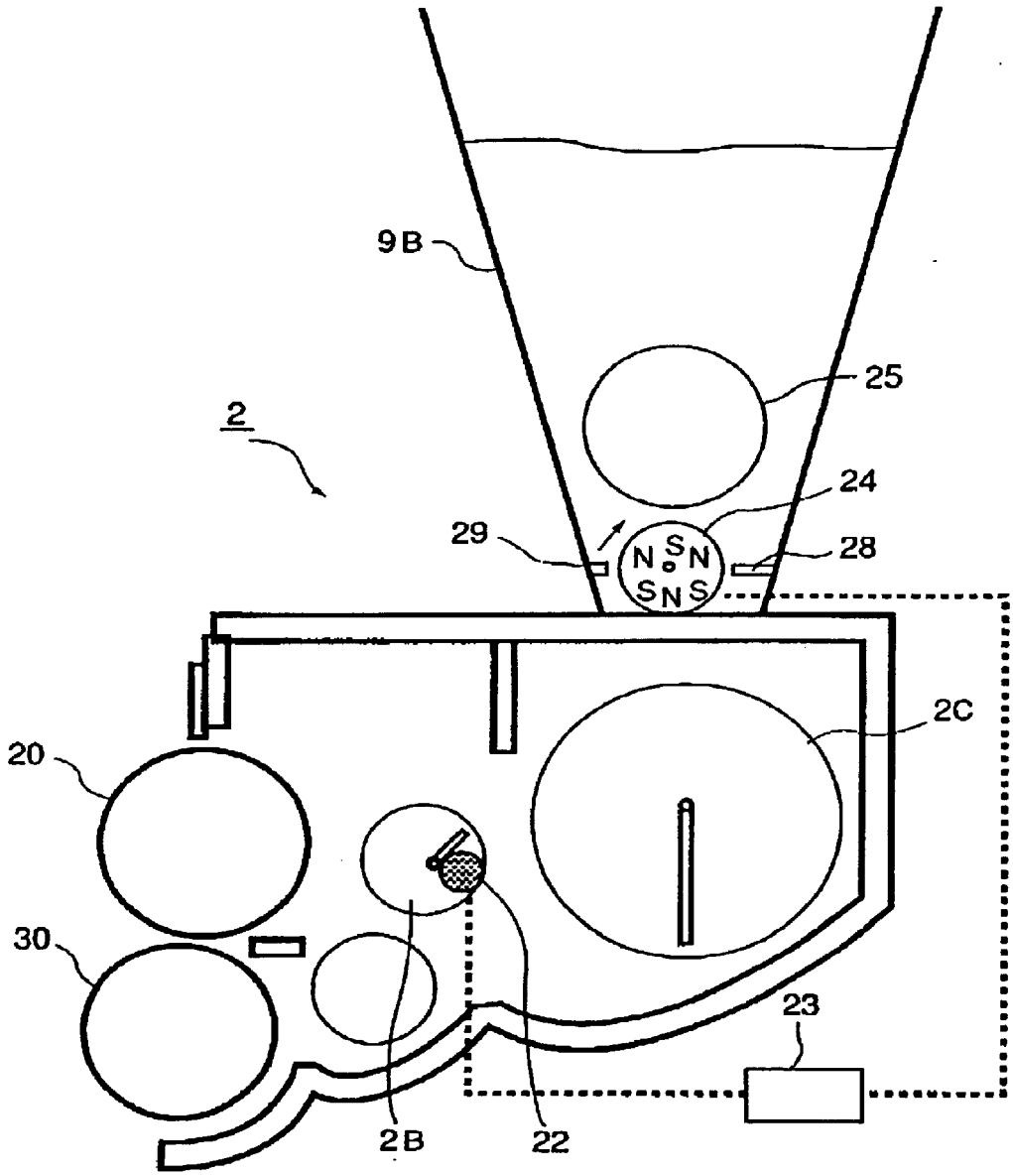
FIG. 2 is a schematic sectional view of a developing apparatus with which an image forming apparatus is equipped.

Thereafter, the latent image is developed into a toner image by a developing apparatus 2. The developing apparatus used in this embodiment employs a simple and highly durable development sleeve (having a maintenance-free service life of 2,000,000 copies), and single-component magnetic black developer. It comprises two developer bearing members: an upstream development sleeve 20 as an upstream developer bearing member, and a downstream development sleeve 30 as a downstream developer bearing member, and employs a reversal developing method. As a piezoelectric element 22 detects the absence of the toner, as developer, in the adjacencies of the stirring rod 2B shown in FIG. 2, a magnetic roller 24 is rotated to allow the toner within a hopper 9B to fall into the developing apparatus 2.

After the development of the electrostatic latent image on the peripheral surface of the photoconductive drum 1 into a toner image, that is, a visual image, by the developing apparatus 2, the toner image is charged by a post-charger 10 as a charging means, which flows the differential current +100 $\mu$A (AC+DC), in order to reduce the attraction between the toner image and photoconductive drum 1 so that the toner image can be easily separated from the photoconductive drum to be transferred. Thereafter, the tone image is transferred by a transfer charger 4 onto a transfer medium as a recording medium which is advancing in the direction indicated by an arrow mark.

After the transfer of the toner image onto the transfer medium, the transfer medium is separated from the photoconductive drum 1 by a separation charger 5, and sent to a fixing apparatus, by which the toner image is fixed.

Next, the developing apparatus 2 in this embodiment will be described in detail.

Figure 3:
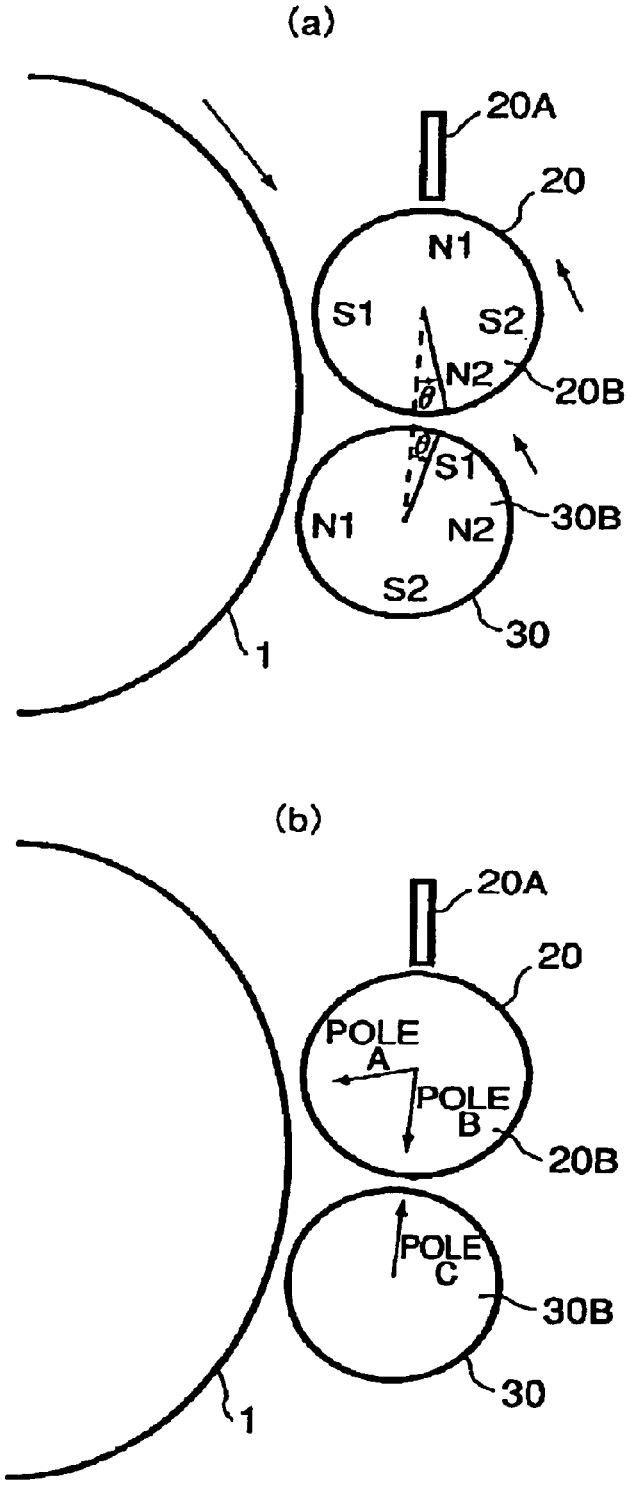
FIGS. 3(*a*) and 3(*b*) are schematic drawings for depicting the positioning of the magnetic poles of the magnetic members placed in the hollow of each of the developer bearing members of the developing apparatus.

Referring to FIG. 3(*a*), the developing apparatus 2 in this embodiment comprises an upstream development sleeve 20 and a downstream development sleeve 30, which are placed close to each other and rotate in the same direction (indicated by an arrow mark in the drawing).

Next, the gist of the present invention will be described.

Figure 4:
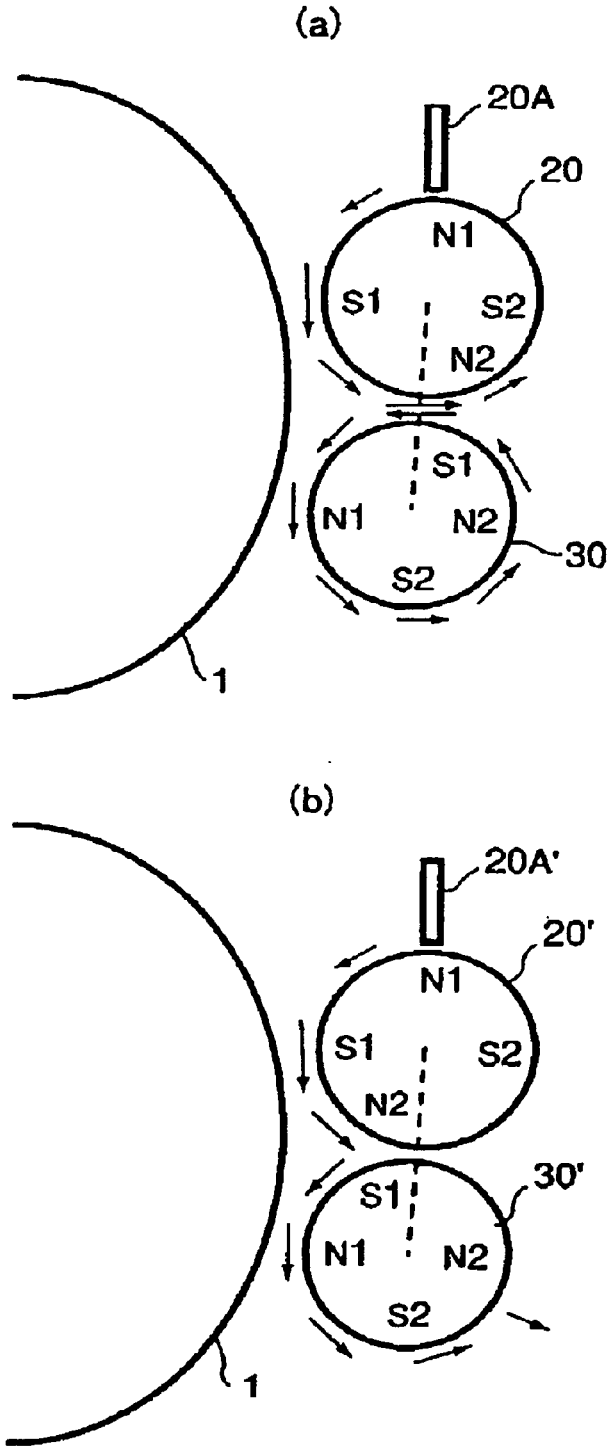
FIGS. 4(*a*) and 4(*b*) are schematic drawings for depicting the movement of the developer on the developer bearing members, when single-component developer and two-component developers, respectively, are used.

Regarding the developer flow caused by the peripheral surfaces of the developer bearing members, in the case of a developing apparatus in accordance with the prior arts, which uses two-component developer, that is, a mixture of toner and carrier, the developer is passed from the upstream developer bearing member to the downstream developer bearing member, as shown in FIG. 4(*b*), at a location at which the distance between the peripheral surfaces of the closely placed upstream and downstream developer bearing members is smallest. In other words, the developer is conveyed by the portions of the development sleeves, on the latent image bearing member side. This is for the following reason. When two-component developer is used, the main contributor to the charging of developer is carrier. Therefore, all that is necessary is for the developer to be conveyed from the developer bearing members to the latent image bearing member.

However, when single-component magnetic developer is used, the essential contributor to the charging of developer is the developer bearing member. Therefore, not only must the developer be coated on the developer bearing member in a thin layer, but also must be sufficiently charged. Thus, the flow of the developer on the downstream developer bearing member must be as shown in FIG. 4(*a*), being clearly different from the flow of the developer on the downstream developer bearing member when two-component developer is used. In other words, when single-component magnetic developer is used, not only must the developing apparatus convey developer to the latent image bearing member, but also charge the developer while uniformly coating the developer on the developer bearing members.

Thus, in this embodiment, the magnets are disposed so that their magnetic poles are positioned as shown in FIG. 3(*b*). That is, a magnetic pole A, as a first magnetic pole, of the magnet within the upstream development sleeve 20 is aligned with the plane connecting the axial lines of the photoconductive drum 1 and upstream development sleeve 20, or is placed in the adjacencies of this plane, whereas a magnetic pole B, as a second magnetic pole, of the magnet within the upstream development sleeve 20 is aligned with the plane connecting the axial lines of the upstream and downstream development sleeves 20 and 30, or in the adjacencies of this plane. Further, a magnetic pole C of the magnet within the downstream development sleeve 30 is aligned with the plane connecting the axial lines of the upstream and downstream development sleeves 20 and 30, or in the adjacencies of this plane.

Further, (1) the magnetic poles A and C are identical in polarity, and the magnetic pole B is different in polarity from the magnetic poles A and C; and (2) |magnetic force of magnetic pole A|>|magnetic force of magnetic pole |B|>|magnetic force of magnetic pole C|.

With the provision of the above arrangement, the toner coat on the peripheral surface of the upstream development sleeve 20 is kept stable.

At this time, the relationship among the first, second, and third magnetic poles will be described in terms of magnetic force and polarity.

First, the relationship between the second and third magnetic poles will be described. Here, the two magnetic poles were positioned as shown in FIG. 4(*b*), but were changed in polarity, in order to studies the effects of this polarity change upon the state of the developer coat on the upstream developer bearing member. The magnetic forces of the second and third magnets were 70 mT.

The results of the studies regarding the relationship between the polarity of the second and third magnetic poles and the state of the developer coat on the upstream developer bearing member are given in Table 1.

TABLE 1

| | Pole C | |
|---|---|---|
| Pole B | N | S |
| N | NG | G |
| S | G | NG |

N: No good
C: Good

According to Table 1, the developer coat on the upstream developer bearing member remains stable when the first and second magnetic poles are different in polarity.

Figure 5:
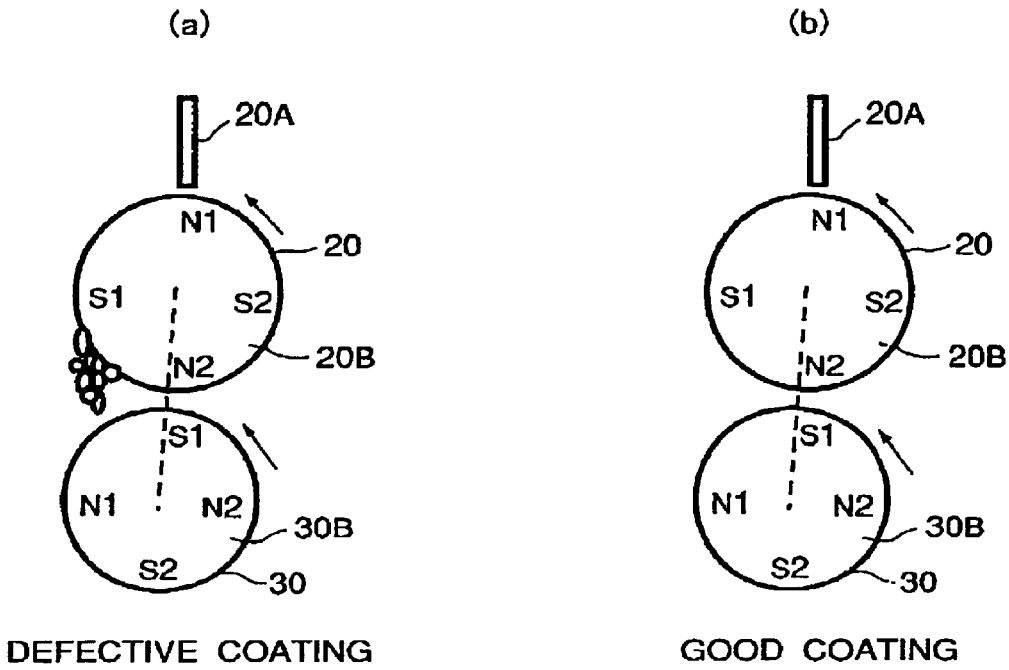
FIGS. 5(*a*) and 5(*b*) are a schematic drawings for depicting the relationship between the state of the developer coat on the upstream developer bearing member, and the positioning and polarity of the magnetic poles of the magnetic members of the developer bearing members.

Further, if the magnetic force across a given area of the peripheral surface of a development sleeve is within a range of 0–10 mT, this are is not capable of conveying the developer. Thus, if the magnetic force across the area of the peripheral surface of the upstream developer bearing member, on the downstream developer bearing member side, is within the range of 0–10 mT, the developer stagnates across this area, as shown in FIG. 5(*a*), failing to remain properly coated. This phenomenon, or the developer stagnation, is more conspicuous when a high revolution developer bearing member is used, because the higher the peripheral velocity of a developer bearing member, the greater the difference by which the velocity at which the developer is conveyed by the peripheral surface of the developer bearing member lags behind the peripheral velocity of the developer bearing member. Further, when the first and second magnetic poles are identical in polarity, the area across which the magnetic force is within the range of 0–10 mT is larger, and therefore, the above described developer stagnation is even more conspicuous.

Thus, the first and second magnetic poles must be different in polarity.

Next, the relationship between the first and third magnetic poles will be described.

The first magnetic pole is the magnetic pole which contributes to development. Thus, in order to prevent the fog generation, its magnetic force is desired to be no less than 80 mT, as is evident from Table 2.

TABLE 2

| MAG. FORCE | 50 mT | 60 mT | 70 mT | 80 mT | 90 mT | 100 mT |
|---|---|---|---|---|---|---|
| FOG PREVENTION | NG | NG | NG | G | G | G |

G: Good
NG: No good

When the first and third magnetic poles are equal in magnetic force, an area across which magnetic force falls within a range of 0–10 mT is created on the peripheral surface of the upstream developer bearing member, between the point corresponding to the first magnetic pole and the plane connecting the axial lines of the upstream and downstream developer bearing members. Therefore, it is desired that the magnetic force of the third magnetic pole is made smaller than that of the first magnetic pole, so that the area, across which the magnetic force is kept within the range of 0–10 mT by the first and third magnetic poles, is created as close as possible to the second magnetic pole. Further, in order to increase the developer conveying force, it is necessary to reduce the effect of the third magnetic pole. This can be achieved by making the second magnetic pole stronger in magnetic force than the third magnetic force. As for the relationship between the magnetic force of the first magnetic pole and the magnetic force of the second magnetic pole, in order to increase the developer conveying force, it is desired that the first and second magnetic poles are different in polarity and one is greater in magnetic force than the other. Further, as described above, the magnetic force of the first magnetic pole is desired to be equal to or greater than 80 mT (magnetic force of first magnetic pole≧80 mT). Thus, the magnetic force of the first magnetic pole should be made greater than that of the second magnetic pole: magnetic force of first magnetic pole>magnetic force of second magnetic pole.

Thus, in order to narrow the portion of the peripheral surface of the upstream developer bearing member, across which the magnetic force is no more than 10 mT because of the interaction among the magnetic forces of the first, second, and third magnetic pole, the relationship in magnetic force among the first, second, and the third magnetic poles, must meet the above described requirements (1) and (2). Further, the studies revealed that the effects of the positioning of the second and third magnetic poles upon the states of the developer coats on the developer bearing members when single-component developer was used was different from those when two-component developer was used. More specifically, if the second and third magnetic poles were positioned on the latent image bearing member side (outward of developing apparatus), with respect to the plane connecting the rotational axes of the upstream developer bearing member and downstream developer bearing member, it became difficult for the downstream developer bearing member to reliably charge the developer. Therefore, the second and third magnetic poles are desired to be placed inward of the developing apparatus (away from latent image bearing member), with respect to the above described plane.

At this time, the results of the studies made, regarding the first, second, and third magnetic poles, to prevent the stagnation of the developer on the peripheral surface of the upstream developer bearing member will be described. In these studies, the state of the developer coat on the upstream developer bearing member was evaluated with reference to the relationship in magnetic force between the first and third magnetic poles, while increasing the magnetic force of the third magnetic pole by increments of 10 mT starting from 40 mT. The results of the evaluation are given in Table 3, in which satisfactory and unsatisfactory conditions are represented by referential symbols G and NG, respectively. Regarding the evaluation, the state of the developer coat such as the state shown in FIG. 5(*a*) is represented by the symbol NG, and the state of developer coat such as the state shown in FIG. 5(*b*) is represented by the symbol G: fog (G: no more than 2%; NG: no less than 2%; and coat stability (NG: halftone image (reflection density D: 0.5) is uneven, and unevenness in terms of density difference is no less than 0.1).

The results are as shown in Table 3.

TABLE 3

| | POLE B | | | | | | |
|---|---|---|---|---|---|---|---|
| POLE A | 40 mT | 50 mT | 60 mT | 70 mT | 80 mT | 90 mT | 100 mT |
| (POLE C = 40 mT) | | | | | | | |
| 40 mT | NG | NG | NG | NG | NG | NG | NG |
| 50 mT | NG | NG | NG | NG | NG | NG | NG |
| 60 mT | NG | G | NG | NG | NG | NG | NG |
| 70 mT | NG | G | G | NG | NG | NG | NG |
| 80 mT | NG | G | G | G | NG | NG | NG |
| 90 mT | NG | G | G | G | G | NG | NG |
| 100 mT | NG | G | G | G | G | G | NG |
| 110 mT | NG | G | G | G | G | G | G |
| (POLE C = 50 mT) | | | | | | | |
| 40 mT | NG | NG | NG | NG | NG | NG | NG |
| 50 mT | NG | NG | NG | NG | NG | NG | NG |
| 60 mT | NG | NG | NG | NG | NG | NG | NG |
| 70 mT | NG | NG | G | NG | NG | NG | NG |
| 80 mT | NG | NG | G | G | NG | NG | NG |

TABLE 3-continued

| | POLE B | | | | | | |
|---|---|---|---|---|---|---|---|
| POLE A | 40 mT | 50 mT | 60 mT | 70 mT | 80 mT | 90 mT | 100 mT |
| 90 mT | NG | NG | G | G | G | NG | NG |
| 100 mT | NG | NG | G | G | G | G | NG |
| 110 mT | NG | NG | G | G | G | G | G |
| (POLE C = 60 mT) | | | | | | | |
| 40 mT | NG | NG | NG | NG | NG | NG | NG |
| 50 mT | NG | NG | NG | NG | NG | NG | NG |
| 60 mT | NG | NG | NG | NG | NG | NG | NG |
| 70 mT | NG | NG | NG | NG | NG | NG | NG |
| 80 mT | NG | NG | NG | G | NG | NG | NG |
| 90 mT | NG | NG | NG | G | G | NG | NG |
| 100 mT | NG | NG | NG | G | G | G | NG |
| 110 mT | NG | NG | NG | G | G | G | G |
| (POLE C = 70 mT) | | | | | | | |
| 40 mT | NG | NG | NG | NG | NG | NG | NG |
| 50 mT | NG | NG | NG | NG | NG | NG | NG |
| 60 mT | NG | NG | NG | NG | NG | NG | KG |
| 70 mT | NG | NG | NG | NG | NG | NG | NG |
| 80 mT | NG | NG | NG | NG | NG | NG | NG |
| 90 mT | KG | NG | NG | NG | G | NG | NG |
| 100 mT | NG | NG | NG | NG | G | G | NG |
| 110 mT | NG | NG | NG | NG | G | G | G |
| (POLE C = 80 mT) | | | | | | | |
| 40 mT | NG | NG | NG | NG | NG | NG | NG |
| 50 mT | NG | NG | NG | NG | NG | NG | NG |
| 60 mT | NG | NG | NG | NG | NG | NG | NG |
| 70 mT | NG | NG | NG | NG | NG | NG | NG |
| 80 mT | NG | NG | NG | NG | NG | NG | NG |
| 90 mT | NG | NG | NG | NG | NG | NG | NG |
| 100 mT | NG | NG | NG | NG | NG | G | NG |
| 110 mT | NG | NG | NG | NG | NG | G | G |
| (POLE C = 90 mT) | | | | | | | |
| 40 mT | NG | NG | NG | NG | NG | NG | NG |
| 50 mT | NG | NG | NG | NG | NG | NG | NG |
| 60 mT | NG | NG | NG | NG | NG | NG | NG |
| 70 mT | NG | NG | NG | NG | NG | NG | NG |
| 80 mT | NG | NG | NG | NG | NG | NG | NG |
| 90 mT | NG | NG | NG | NG | NG | NG | NG |
| 100 mT | NG | NG | NG | NG | NG | NG | NG |
| 110 mT | NG | NG | NG | NG | NG | NG | G |
| (POLE C = 100 mT) | | | | | | | |
| 40 mT | NG | NG | NG | NG | NG | NG | NG |
| 50 mT | NG | NG | NG | NG | NG | NG | NG |
| 60 mT | NG | NG | NG | NG | NG | NG | NG |
| 70 mT | NG | NG | NG | NG | NG | NG | NG |
| 80 mT | NG | NG | NG | NG | NG | NG | NG |
| 90 mT | NG | NG | NG | NG | NG | NG | NG |
| 100 mT | NG | NG | NG | NG | NG | NG | NG |
| 110 mT | NG | NG | NG | NG | NG | NG | NG |

The sub-tables in Table 3 represent the relationship between the state of the developer coat on the upstream developer bearing member, and the magnetic forces when the magnetic force the third magnetic pole was varied from 40 mT to 100 mT by increments of 10 mT. They show the state of the developer coat after 10,000 copies were actually produced, with the magnetic force of the third magnetic pole set to the level given at the top left corner of each sub-table.

From Table 3, it is evident that when:

(1) the first and third magnetic poles are the same in polarity, and the second magnetic pole is different in polarity from the first and third magnetic poles; and (2) |magnetic force of magnetic pole A|>|magnetic force of magnetic pole B|>|magnetic force of magnetic pole C|, the developer coat on the upstream developer bearing member remains stable.

An angle θ in FIG. 3(*a*) was set to 5°. The studies similar to the above described ones were carried out, with this angle θ varied within a range of 0–20°. Quantitatively, there were no significant differences. In the present invention, the plane (dotted line in FIG. 3(*a*)) connecting the rotational axes of the two sleeves corresponds to the value 0 of this angle θ. The positive and negative directions are the directions in which the second and third magnetic poles move away, or toward, the photoconductive drum 1, respectively.

The polarity, magnetic pole positioning, and magnetic force strength of the magnets in the upstream and downstream development sleeves 20 and 30 are given in Table 4 and Table 5, respectively.

TABLE 4

| | MAG. FORCE | ANGLE (deg.) | HALF-PEAK WIDTH (deg.) |
|---|---|---|---|
| N1 | 950 | 0 | 40 |
| N2 | 900 | 100 | 40 |
| S1 | 1000 | 170 | 40 |
| S2 | 600 | 270 | |

TABLE 5

| | MAG. FORCE | ANGLE (deg.) | HALF-PEAK WIDTH (deg.) |
|---|---|---|---|
| N1 | 1000 | 85 | 40 |
| N2 | 700 | 270 | 40 |
| S1 | 700 | −5 | 40 |
| S2 | 600 | 180 | |

Figure 6:
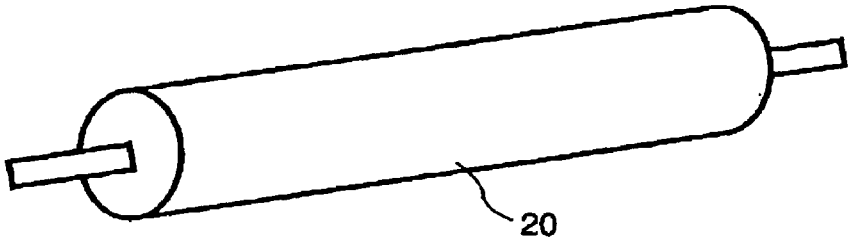
FIG. 6 is a schematic perspective view of the developer bearing member of a developing apparatus.

Referring to FIG. 6, the upstream development sleeve 20 is a stainless steel (SUS305) cylinder, that is, a nonmagnetic member, with a diameter of 20 mm. The peripheral surface of the cylinder has been blasted with FGB #600, and has then been coated.

Within the hollow of the upstream development sleeve 20, a magnet 20B as a magnetic member having a magnetic field pattern shown in FIG. 3(*a*) and Table 4 is stationarily disposed. The upstream development sleeve 20 is rotated at the 150% of the peripheral velocity of the photoconductive drum 1.

The toner particle layer on the upstream development sleeve 20 is regulated in thickness by a magnetic blade 20A. In this embodiment, the distance S-Bgap between the upstream development sleeve 20 and magnetic blade 20A is 250 μm.

The distance S-Dgap between the upstream development sleeve 20 and photoconductive drum 1 is 200 μm. In this embodiment, a latent image is developed by applying to the upstream development sleeve 20 a combination of a DC bias voltage of +300 V, and an AC bias voltage having the rectangular waveform shown in FIG. 7, a peak-to-peak voltage of 1,200 Vpp, and a frequency of 2.5 kHz, with the use of a bias applying means (unshown), and single-component magnetic developer, without placing the upstream development sleeve 20 in contact with the photoconductive drum 1. Thus, the development contrast, which causes toner particles to jump from the upstream development sleeve 20 to the photoconductive drum 1, is 200 V and the fog prevention contrast is 150 V.

The downstream development sleeve 30 is similar to the upstream development sleeve 20. It is a stainless steel (SUS305) cylinder, that is, a nonmagnetic member, with a diameter of 20 mm. Its peripheral surface has been blasted with FGB #600; it has a surface roughness Rz of 3 μm. The surface roughness Rz was measured using a contact surface roughness gauge (Surfcorder SE-3300 of Kosaka Lab., Ltd.) As for the measurement conditions, the cutoff value was 0.8 mm; measurement length, 2.5 mm; feeding speed: 0.1 mm/sec; and magnification was 5,000×.

Within the hollow of the downstream development sleeve 30, a magnet 30B as a magnetic member is stationarily disposed, which has four magnetic poles positioned as shown in FIG. 3(*a*), and the magnetic field pattern shown in Table 5.

Figure 7:
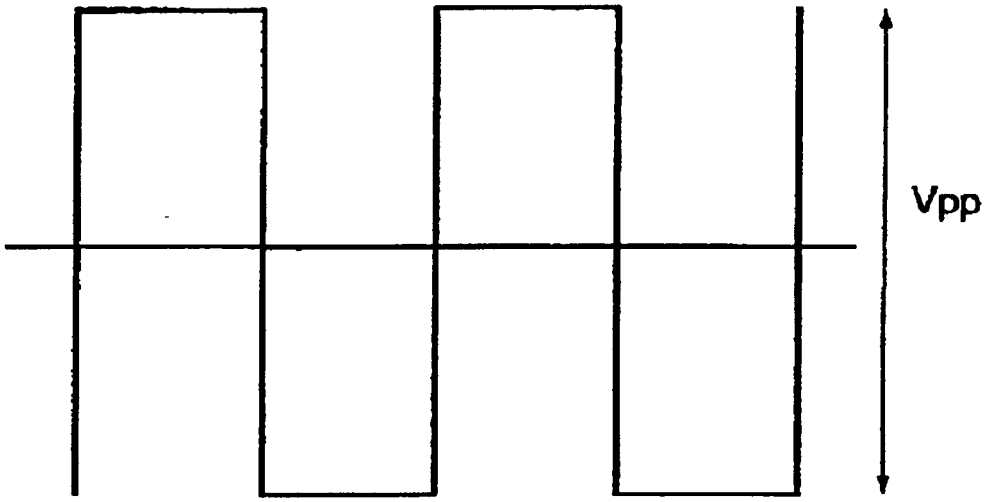
FIG. 7 is a schematic drawing for depicting the waveform of the alternating component of the bias voltage applied to the developer bearing member.

To the downstream development sleeve 30, a DC bias voltage of +300, and an AC voltage having the rectangular waveform shown in FIG. 7, a peak-to-peak voltage of 1,200 Vpp, and a frequency of 2.5 kHz, can be applied in combination. In this embodiment, the development bias voltage applied to the downstream development sleeve 30 is identical to the development bias voltage applied to the upstream development sleeve 20. Therefore, cost can be reduced by making a structural arrangement so that a single power source can be shared by the bias applying means for the upstream development sleeve 20 and bias applying means for the downstream development sleeve 30. Such an arrangement reduces the space necessary for the power source, contributing to special efficiency.

The downstream development sleeve 30 is rotated at the 150% of the peripheral velocity of the photoconductive drum 1.

The toner particle layer on the peripheral surface of the downstream development sleeve 30 is regulated in thickness by the upstream development sleeve 20. In this embodiment, the distance S-Dgap between the peripheral surfaces of the downstream development sleeve 30 and photoconductive drum 1 is 250 μm.

Figure 8:
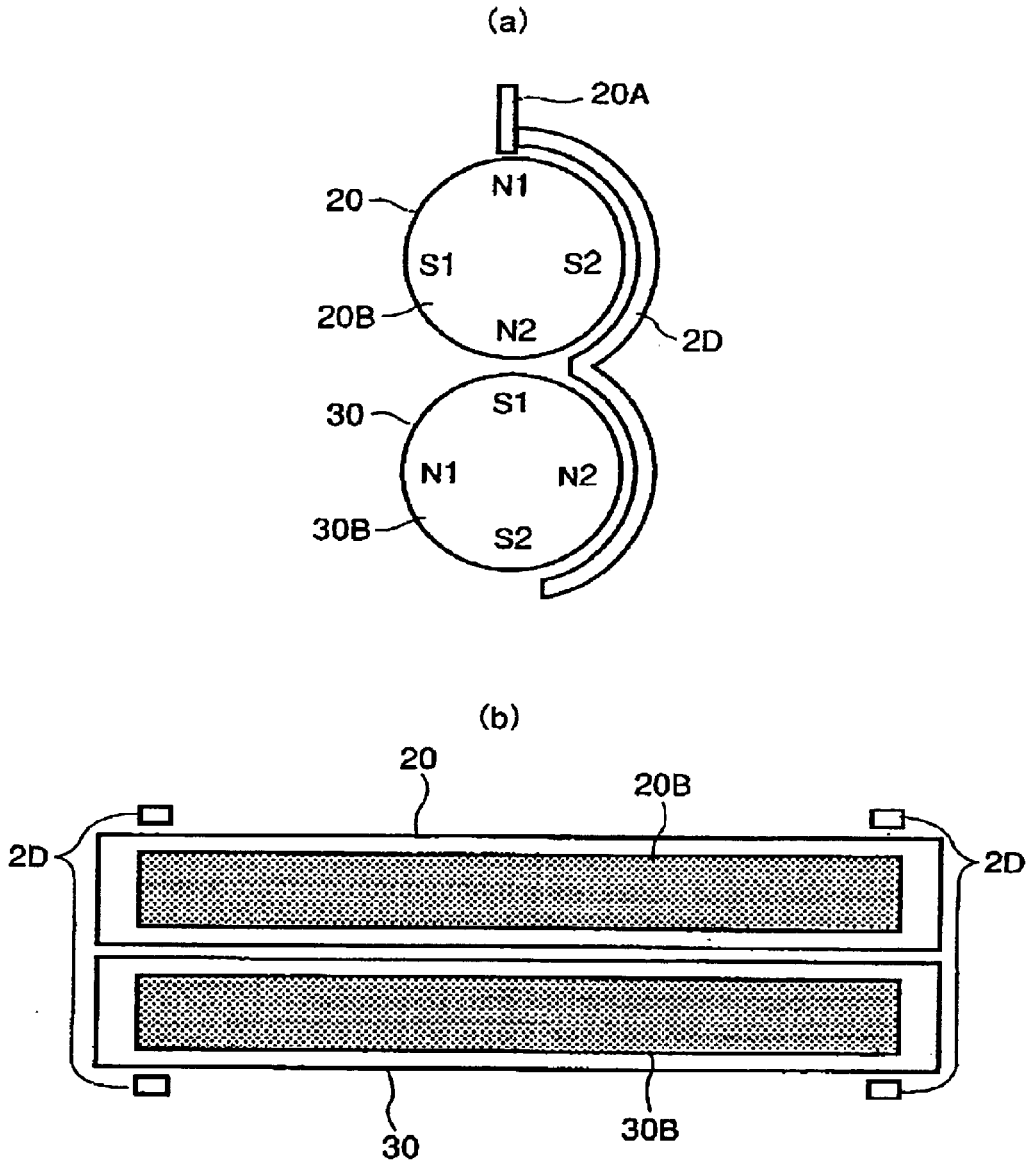
FIGS. 8(*a*) and 8(*b*) are a schematic drawings for depicting the positional relationships between the magnetic members of the developer bearing members, and the seals placed at the ends of the developer bearing members in terms of the axial directions of the developer bearing members.

Referring to FIG. 8(*a*), in this embodiment, the upstream development sleeve 20 contains the magnet 20B with four magnetic poles, and the downstream development sleeve 30 contains the magnet 30B with four magnetic poles. Referring to FIG. 8(*b*), there is a magnetic sealing member 2D at each end of the upstream development sleeve 20 and downstream development sleeve 30 in terms of lengthwise direction. The magnetic sealing member 2D is formed of MOLD-ALLOY (KN plated; 10.6 in permeability), the main component of which is iron, and is shaped to conform to the contour of the peripheral surface of the corresponding development sleeve. The gaps between the magnetic sealing member 2D and upstream development sleeve 20, and between the magnetic sealing member 2D and downstream development sleeve 30, are both 400 μm±100 μm.

In this embodiment, the lengths L1 and L2 of the magnets 20B and 30B, respectively, in terms of the axial direction of the upstream development sleeve 20 and downstream development sleeve 30 are 305 mm and 305 mm, respectively.

As for the optimal positioning of the magnetic sealing members 2D relative to the magnets 20B and 30B in terms of the axial directions of the upstream development sleeve 20 and downstream development sleeve 30, it is desired that the magnetic sealing members 2D are positioned so that the outward end surface of each magnetic sealing member 2D aligns with the end surface of the corresponding lengthwise end fo the corresponding magnet. This is for the following reason. If the magnets 20B and 30B extend beyond the outward end of the corresponding magnetic sealing member 2D, in terms of the axial directions of the two magnets 20B and 30B, magnetic force will be present beyond the end of the magnetic sealing member 2D (in terms of the above described axial directions). Therefore, some of the toner will be displaced outward beyond the magnetic sealing member 2D, by this magnetic force, and will eventually leak. In principle, the magnetic sealing members 2D are for forming magnetic brushes between themselves and the magnets 20B and 30B for the purpose of toner leak prevention. However, if the magnetic sealing member 2D is positioned so that the end surface of the corresponding magnet is positioned inward of the developing apparatus, in terms of the axial direction of the magnet, with respect to the magnetic sealing member 2D, a magnetic brush having a width equal to that of the magnetic sealing member 2D is formed on the portion of the corresponding development sleeve, on the outward side, with respect to the outward end surface of the corresponding magnet, in terms of the axial direction of the magnet, in spite of the absence of the magnetic force from the magnet. Therefore, if the distance between the sealing member 2D and the outward end surface of the corresponding magnet is substantial when the magnetic sealing member 2D is positioned so that the end surface of the corresponding magnet is positioned inward of the developing apparatus, in terms of the axial direction of the magnet, with respect to the magnetic scaling member 2D, the toner particles on the portion of the development sleeve, on the upward side, with respect to the outward end surface of the magnet, in terms of the axial direction of the magnet, leak from the lengthwise end of the developing apparatus, and additionally, the toner particle layers on the upstream development sleeve 20 and downstream development sleeve 30 become thick, sometimes allowing the toner particles to fall off in agglomeration. In this embodiment, in consideration of the presence of a certain amount of play in terms of the above described lengthwise direction among the upstream development sleeve 20, downstream development sleeve 30, magnet 20B, and magnet 30B, each magnetic sealing member 2D is disposed so that its outward end surface is positioned 1 mm inward of the corresponding end surface of the magnet 20B or 30B, in terms of the axial directions of the magnets 20B or 30B, as shown in FIG. 8(*b*).

Next, the image forming process in this embodiment will be described.

In this embodiment, the image formation data are processed in the following manner by an image signal controlling portion, shown in FIG. 9; they are converted into binary data using the dither method.

Figure 9:
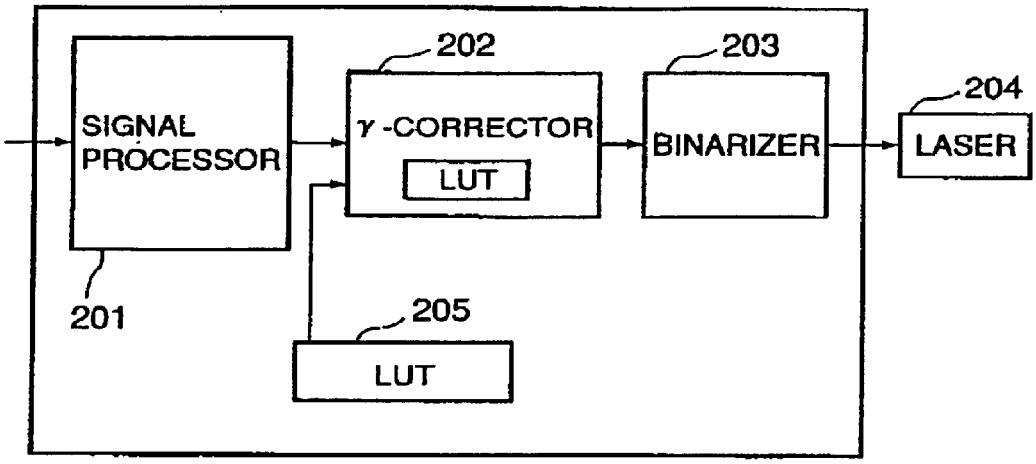
FIG. 9 is a diagram for depicting the image processing.

Referring to FIG. 9, an image processing portion 201 processes the inputted image signals based on the instruction given by an operator; for example, it changes resolution.

A γ correction portion 202 corrects the image signals in terms of the gamma (γ) by referring to a lookup table (LUT) created by a LUT calculating portion 205.

A binary conversion portion 203 generates signals for driving the laser, based on the image signals corrected in the gamma.

Then, a laser 204 is driven by the driving signals outputted from the binary conversion portion 203, and emits a beam 12 of image exposure light in accordance with the above described image formation data. In this embodiment, the lookup table is created in the correction portion 202 so that the lookup table matches the development contrast in the operational environment in which the image forming apparatus is operated.

As described above, in this embodiment, not only is correction made for the development contrast, but also for gradation (for example, γ correction or the like). Then, the lookup table for the correction portion 202 is refreshed so that the corrected gradation effects an ideal tone reproduction curve.

The effects of the present invention obtained when a latent image formed on a negatively chargeable photoconductive drum is developed using positively chargeable toner are the same as those obtained when a latent image formed on a negatively chargeable photoconductive drum is developed using negatively chargeable toner.

In this embodiment, development bias voltage comprising an AC component is applied to the developer bearing member. Therefore, if an excessive amount of toner is adhered to the peripheral surface of the photoconductive drum 1 by the upstream development sleeve 20, the excessive portion can be recovered into the developing apparatus 2 by the downstream development sleeve 30, contributing to the reduction in toner consumption. The measured toner consumption per copy (6% in image ratio) was 50–60 mg/copy for a conventional developing apparatus employing single-component magnetic developer, and 41 mg/copy for the developing apparatus in this embodiment.

In other words, according to this embodiment, it is possible to provide a small and maintenance-free developing apparatus, which is capable of uniformly and reliably coating developer on the upstream developer bearing member so that an image of high quality, in particular, in terms of density, can be reliably produced, and also is smaller in toner consumption. In other words, it is possible to provide a compact developing apparatus suitable for a small high speed print-on-demand apparatus employing a distributed developing system Embodiment 2

Next, referring to FIG. 10, the second embodiment of the present invention will be described. The structural arrangements in this embodiment similar to those in the first embodiment will be not described.

Generally speaking, when the surface of the developing sleeve is SUS or Al bare tube, the triboelectric charge of the developer is not easily controlled. In view of this, according to this embodiment, the triboelectric charge of the toner provided by the upstream developing sleeve (upstream developer carrying member) and that by the downstream developing sleeve (downstream developer carrying member) is controlled by employing optimum coating methods for the upstream developing sleeve and the downstream developing sleeve, respectively, and the use is made with one-component magnetic toner having a negative charging property.

The magnetic pole of the upstream developing sleeve, in consideration of the feeding performance of the toner, has 5 poles to form a repelling poles within the developing device of the upstream developing sleeve to once separated a large cake of the toner from the developing sleeve to suppress the influence of the cake is constantly carried by the developing sleeve. The coating on the surface of the developing sleeve is provided in order to prevent a sleeve ghost image arising at the cyclic period of rotation of the developing sleeve which is pointed out by Japanese Laid-open Patent Application Hei-3-36570 or the like and to enhance the durability of the surface of the developing sleeve. In this embodiment, the distance d between the developing sleeve is 600 μm.

The image forming apparatus uses an a-Si photosensitive drum having a diameter of 108 member as the latent image bearing member. Similarly to first embodiment, the process speed is 470 mm/sec for each, and it is a black and white digital copying machine capable of processing 90 sheets per minute. In this embodiment, the developer is negative charged toner having a weight average particle size of 7.5 μm, and 1.0% (weight %) of $SiO_2$ is externally added.

In this embodiment, the coating film of the developing sleeve is provided by mixing phenolic resin, crystallinity graphite and carbon and curing the mixture on the surface of the Al developing sleeve into a film thickness 10 μm under 150° C. ambient condition. The thickness of the film is preferably 20 μm from the standpoint of forming a stable and uniform film. The P/B ratio is 1/2.5 in this case. Here, B is the weight of the resin material, and P is the weight of the material (crystallinity graphite+carbon) other than the resin material.

When the toner coating amount on the downstream developing sleeve is regulated by the upstream developing sleeve as in this embodiment, the use is made with phenolic resin containing 70 parts by weight quarternary ammonium salt only for the downstream developing sleeve since otherwise, the charging particularly property relative to the negative property toner is too high.

When the quarternary ammonium salt compound is added, it is uniformly dispersed in the phenolic resin, and when the phenolic resin is formed into a coating by heating curing, the quarternary ammonium salt is taken in the structure of the phenolic resin with the result that phenolic resin composition acquires a negative charging property. Therefore, the developer can be conveniently charged to the positive polarity, if the developer carrying member having a coating layer of the above-described material is used.

Examples of the quarternary ammonium salts having the preferable function include the following:

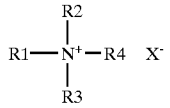

Wherein R1, R2, R3 and R4 each represent an alkyl group which may have a substituents, aryl group which may have a substituent, or an arlkyl group, and R1–R4 may be the same or different. $X^-$ represents anion of acid.

In this general formula, examples of the acid ion $X^-$ include organic sulfate ions, organic sulfonate ions, organic phosphate ions, molybdate ions, tungstate ions, and heteropolyacid containing molybdenum atoms or tungsten atoms, or the like.

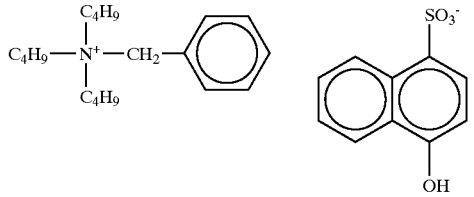

When the coating layer is formed using a resin material composition of a phenolic resin added with a quarternary ammonium salt compound, as shown above, the quarternary ammonium salt compound is taken into the phenolic resin when the phenolic resin which is the binder resin is heat-cured into the coating layer. Therefore, as contrasted to the above-described material added with the negative property silica particles or negative property Teflon particles or the like, the positive triboelectric charging performance relative to the positive chargeable developer is enhanced over the entire coating layer. In addition, as contrasted to the coating of the particle addition type, the process property is not deteriorated, or the strength of the coating layer is not deteriorated.

Examples of the quarternary ammonium salt compound preferably usable with the present invention include the following which however does not limit the present invention.

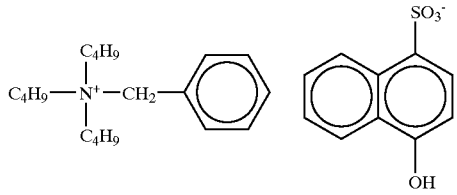

-continued

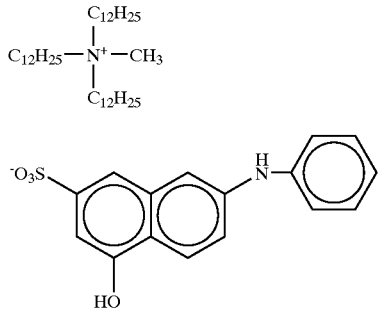

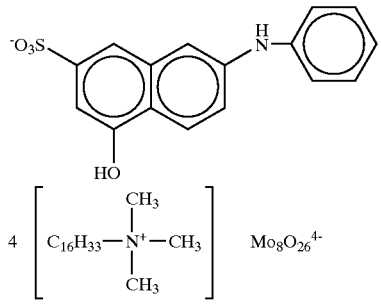

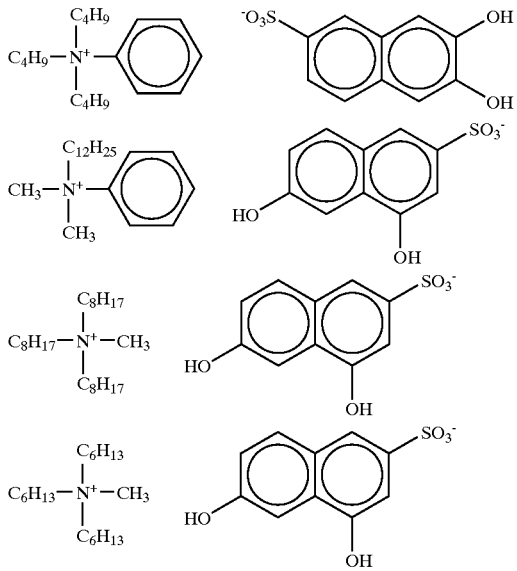

As for the phenolic resin constituting the binder resin used in the present invention, if the one which used a nitrogen-containing compound as a catalyst in the manufacturing step, is used, the quarternary ammonium salt compound is relatively easily taken into the structure of the phenolic resin particularly during the heating curing. Therefore, it is preferable to use from the standpoint of preventing charge-up of the toner. In this invention, such a phenolic resin produced using a nitrogen-containing compound catalyst in the manufacturing step, is used as one of the materials of the coating layer on the developer carrying member, the developing device in which the toner charge-up is prevented can be provided.

Examples of the nitrogen-containing compound usable as the catalyst in the manufacturing step of the phenolic resin, for example, ammonium salt such as ammonium sulfate, ammonium phosphate, ammonium sulfaminate, ammonium carbonate, ammonium acetate, ammonium maleate, or amine salt, as acidic catalysts; ammonia, and amino compounds such as dimethylamine, diethylamine, diisoproplylamine, diisobutylamine, diamylamine, trimethylamine, triethylamine, tri-n-butylamine, triamylamine, dimethylbenzylamine, diethylbenzylamine, dimethylaniline, diethylaniline, N,N-di-n-butylaniline, N,N-di-amylaniline, N,N-di-t-amylaniline, N-methylethanolamine, N-ethylethanolamine, diethanolamine, triethanolamine, dimethylethanolamine, diethylethanolamine, ethyldiethanolamine, n-butyldiethanolamine, di-n-butylethanolamine, triisopropanolamine, ethylenediamine and hexamethylenetetramine, and nitrogen-containing hetrocyclic compound, as basic catalyst. The nitrogen-containing hetrocyclic compound may include pyridine and derivative thereof such as pyridine, α-picoline, β-picoline, γ-picoline, 2,4-lutidine or 2,6-lutidine; quinoline compound; and imidazole and the derivative thereof such as imidazole, 2-methylimidazole, 2,4-dimethylimidazole, 2-ethyl-4-methylimidazole, 2-phenylimidazole, 2-phenyl-4-methylimidazole and 2-heptadecylimidazole.

In the present invention, in order to adjust the resistance value of the coating layer to said value, it is preferable to contain the following electroconductive material in the coating layer. The electroconductive material are, for example, metal powder members of aluminum, copper, nickel, silver and so on, metal oxide such as oxide antimony, oxide indium, tin oxide and so on, carbide such as carbon fiber, carbon black, graphite and so on. Among them, carbon black, inter alia amorphous carbon was used in this invention, because it is excellent in the electroconductivity, because the electroconductivity can be given by adding in the polymeric material and because any electroconductivities can be quite freely provided only by adjusting the amount thereof.

In this embodiment, the prescription of the film was:

phenolic resin: 250 parts by weight;

graphite having an average particle size of 7.5 μm: 90 parts by weight;

carbon: 10 parts by weight; and quarternary ammonium: 70 parts.

As regards the ratio of the graphite and carbon contents, it is preferable that content of the graphite is not less than 3 times the content of the carbon, In order to stabilize the resistance of the entirety of the film. The coating is provided on the developing sleeve by spray method and drying at 1500 for 30 min.

By the optimization of the coating, according to this embodiment, the triboelectric charge (charge amount) is 9 μC/g on the upstream developing sleeve, and 9.2 μC/g on the downstream developing sleeve, which are substantially the same, although the amount of triboelectric charge is larger on downstream developing sleeve than the other, normally. Therefore, the development particularly property is stabilized since the properties of the developing sleeves are optimum against the variation of the ambient condition between the high temperature and high humidity and normal temperature low humidity.

Figure 10:
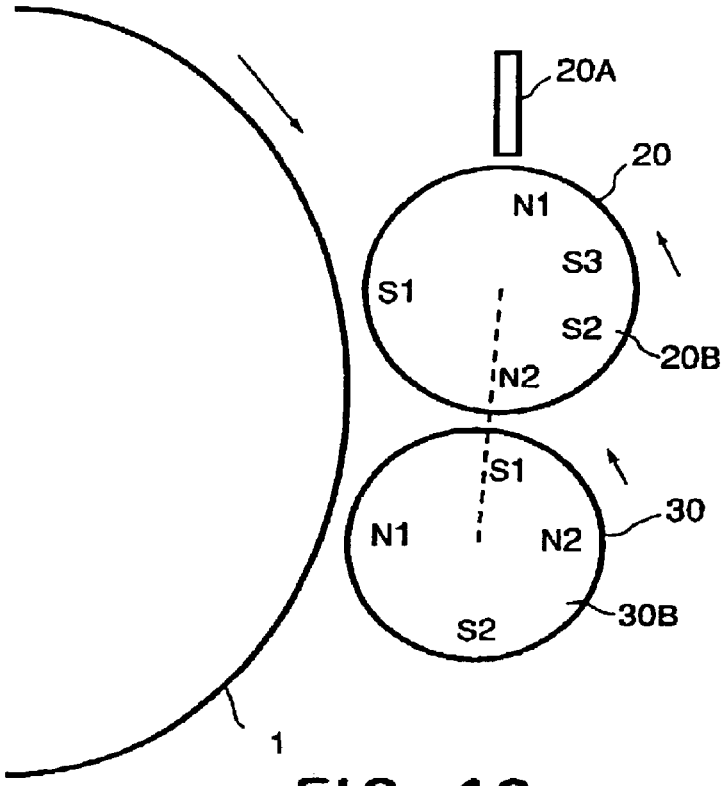
FIG. 10 is a schematic drawing for depicting the positioning of the magnetic poles of the magnetic members in the developer bearing members of the developing apparatus.

Within the hollow of the upstream development sleeve 20, a magnet having five magnetic poles and the magnetic field pattern, shown in FIG. 10 and Table 4, is stationarily disposed.

TABLE 6

| | MAG. FORCE | ANGLE (deg.) | HALF-PEAK WIDTH (deg.) |
|---|---|---|---|
| N1 | 950 | 0 | 40 |
| N2 | 900 | 100 | 40 |
| S1 | 1000 | 170 | 40 |
| S2 | 600 | 300 | |
| S3 | 700 | 250 | |

The upstream development sleeve 20 is rotated at the 125% of the peripheral velocity of the photoconductive drum 1. The toner particle layer on the upstream development sleeve 20 are regulated in thickness by a magnetic blade 20A The distance S-Bgap between the upstream development sleeve 20 and magnetic blade 20A is 250 μm. The distance S-Dgap between the upstream development sleeve 20 and photoconductive drum 1 is 200 μm. In this embodiment, a latent image is developed by applying to the upstream development sleeve 20 a combination of a DC bias voltage of −550 V, and an AC bias voltage having the rectangular waveform shown in FIG. 7, a peak-to-peak voltage of 1,500 Vpp, and a frequency of 2.7 kHz, with the use of single-component magnetic developer, without placing the upstream development sleeve 20 in contact with the photoconductive drum 1. Thus, the development contrast, which causes toner particles to jump from the upstream developer bearing member to the photoconductive drum 1, is 350 V and the fog prevention contrast is 150 V.

The downstream development sleeve 30 is an aluminum (A2017) cylinder, that is, a nonmagnetic member, with a diameter of 20 mm. Its peripheral surface has been coated with film. Within the hollow of the downstream development sleeve 30, a magnet is stationarily disposed, which has four magnetic poles positioned in the pattern shown in FIG. 10, and the specifications of which are given in Table 5.

TABLE 7

| | MAG. FORCE | ANGLE (deg.) | HALF-PEAK WIDTH (deg.) |
|---|---|---|---|
| N1 | 1000 | 85 | 40 |
| N2 | 700 | 270 | 40 |
| S1 | 700 | −5 | 40 |
| S2 | 600 | 180 | |

To the downstream development sleeve 30, a DC bias voltage of −550 V, and an AC voltage having the rectangular waveform shown in FIG. 7, a peak-to-peak voltage of 1,500 Vpp, and a frequency of 2.7 kHz, are applied in combination. The AC and DC voltages applied to the downstream development sleeve 30 are identical to those applied to the upstream development sleeve 20. Therefore, cost can be reduced by making a structural arrangement so that a single power source can be shared by the bias applying means for the upstream development sleeve 20 and bias applying means for the downstream development sleeve 30. Such an arrangement has merit in that it reduces the space necessary for a power source. The downstream development sleeve 30 is rotated at the 125% of the peripheral velocity of the photoconductive drum 1.

The toner particle layer on the peripheral surface of the downstream development sleeve 30 is regulated in thickness by the upstream development sleeve 20. The distance d between the peripheral surfaces of the upstream development sleeve 20 and downstream development sleeve 30 is 600 μm.

The positioning of the magnetic poles of the magnets in the upstream development sleeve 20 and downstream development sleeve 30, and the specifications of the magnets, are given in Tables 6 and 7. In other words, the magnet in the upstream development sleeve 20 has five poles, whereas the magnet in the downstream development sleeve 30 has four poles. The reason why the magnet in the upstream development sleeve 20 was given five poles is as described before.

Thus, according to this embodiment, it is possible to provide a small maintenance-free developing apparatus, which uses single-component magnetic developer, and yet, is capable of uniformly coating developer on the peripheral surface of an upstream developer bearing member so that an image of high quality, in particular, in terms of density, can be produced, and is smaller in toner consumption. In other words, according to this embodiment, it is possible to provide a compact developing apparatus suitable for a high speed print-on-demand apparatus employing a distributed developing system. Further, it is possible to reduce the toner deterioration by reducing the amount by which toner particles remain stuck on the upstream developer bearing member during the rotation of the upstream developer bearing member. Further, it is possible to use a coating method optimal, in terms of charge characteristic, for the toner in use, in order to control toner charge.

Embodiment 3

Next, the third embodiment of the present invention will be described. The structural arrangements in this embodiment similar to those in the first or second embodiment will be not described.

The developing apparatus in this embodiment is identical to that in the second embodiment.

The characteristic feature of this embodiment is that the present invention is applied to an image forming apparatus which recycles toner.

The toner which is reused in an image forming apparatus is basically the waste toner, that is, the toner which was recovered during the cleaning process, in other words, the toner which was not transferred, and remained on a developer bearing member. Therefore, it is inferior in the amount of triboelectrical charge, compared to the fresh toner; the amount of the triboelectrical charge it carries is extremely small. In other words, it contains a large amount of inversely charged components. Therefore, it scatters more easily. This embodiment is put together in consideration of the above described properties of the waste toner.

The magnetic poles of the upstream development sleeve and downstream development sleeve, and formula of the film coated on the downstream development sleeve, in this embodiment, are identical to those in the second embodiment.

Figure 11:
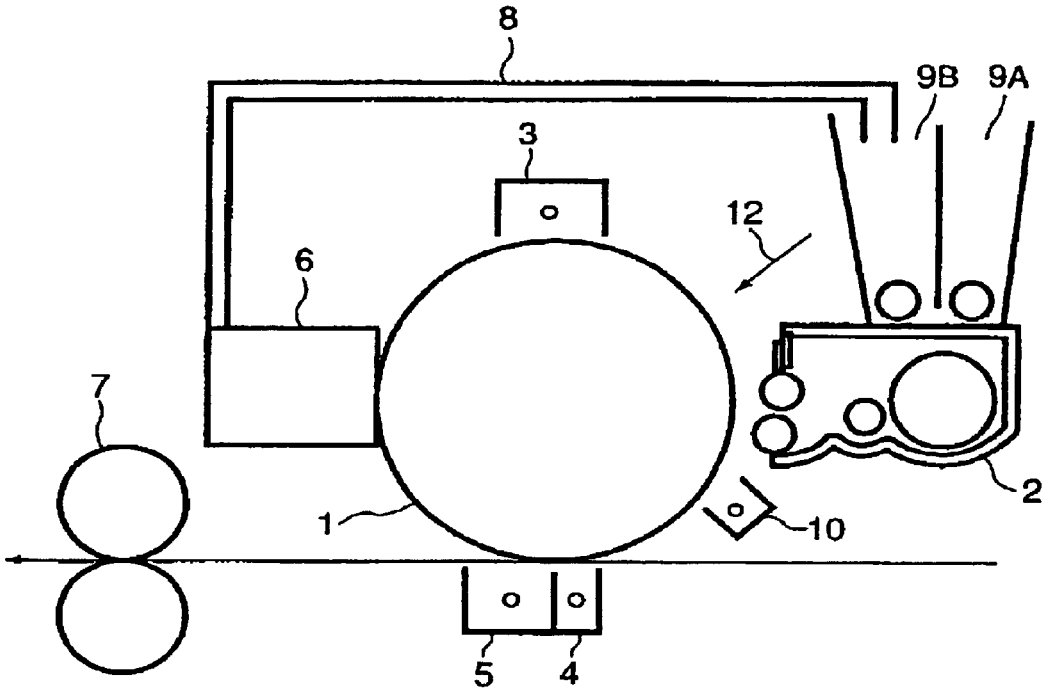
FIG. 11 is a schematic sectional view of another image forming apparatus, for showing the general structure thereof.
Figure 12:
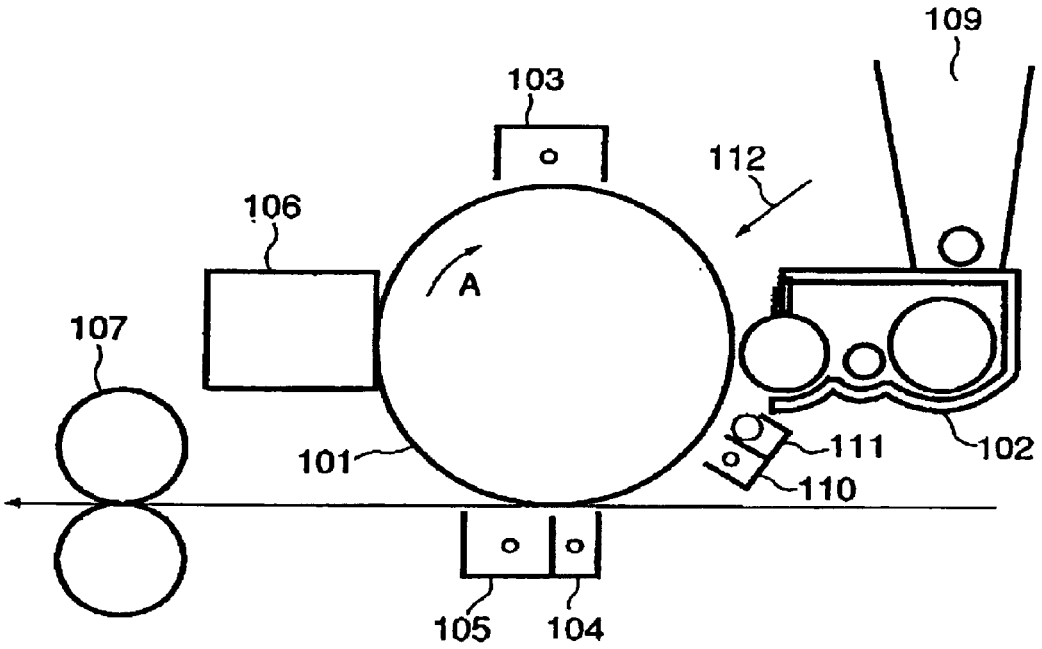
FIG. 12 is a schematic sectional view of an image forming apparatus in accordance with the prior arts, for showing the general structure thereof.
Figure 13:
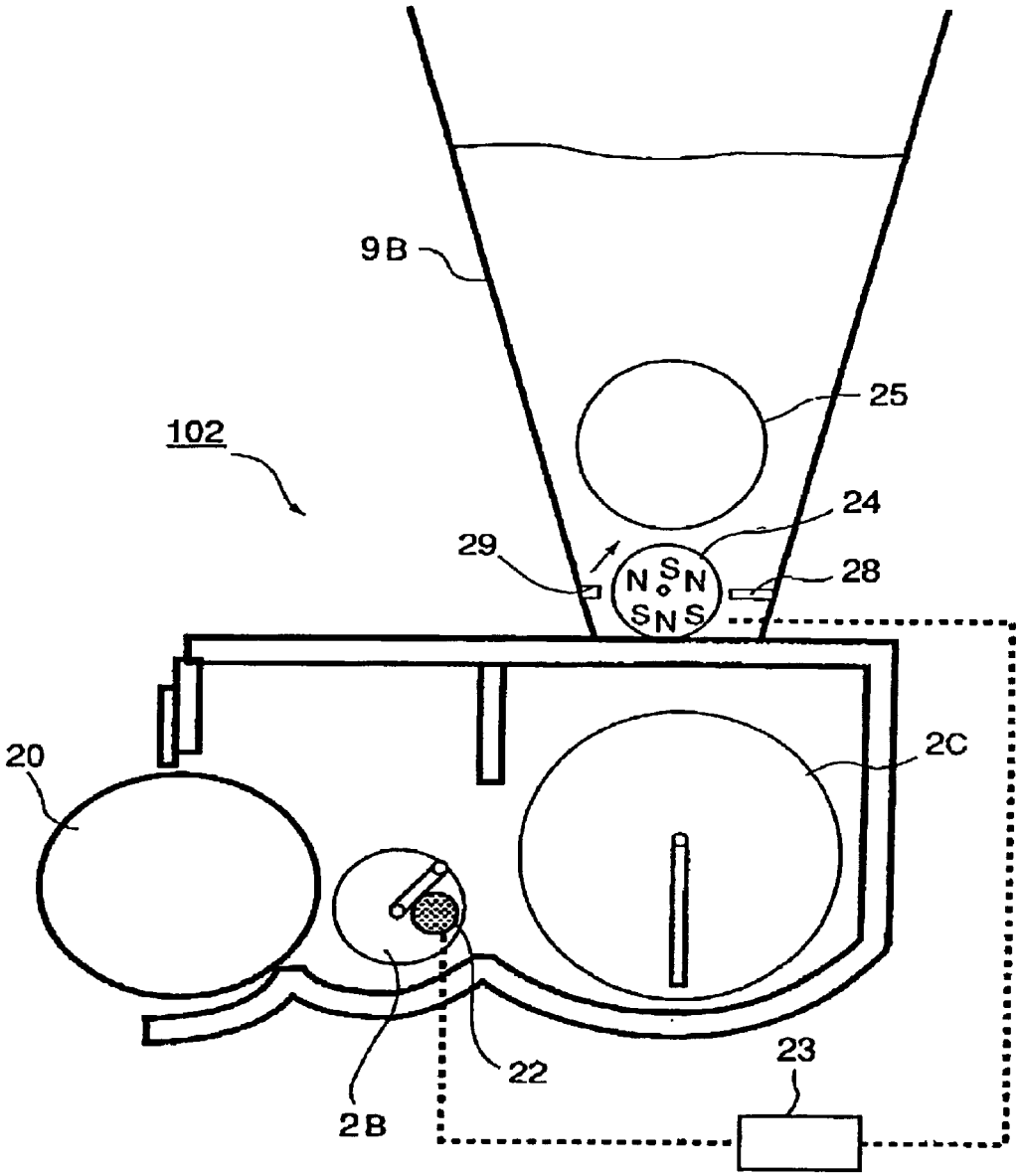
FIG. 13 is a schematic sectional view of the developing apparatus equipped in the image forming apparatus shown in FIG. 12, for showing the general structure thereof.
Figure 14:
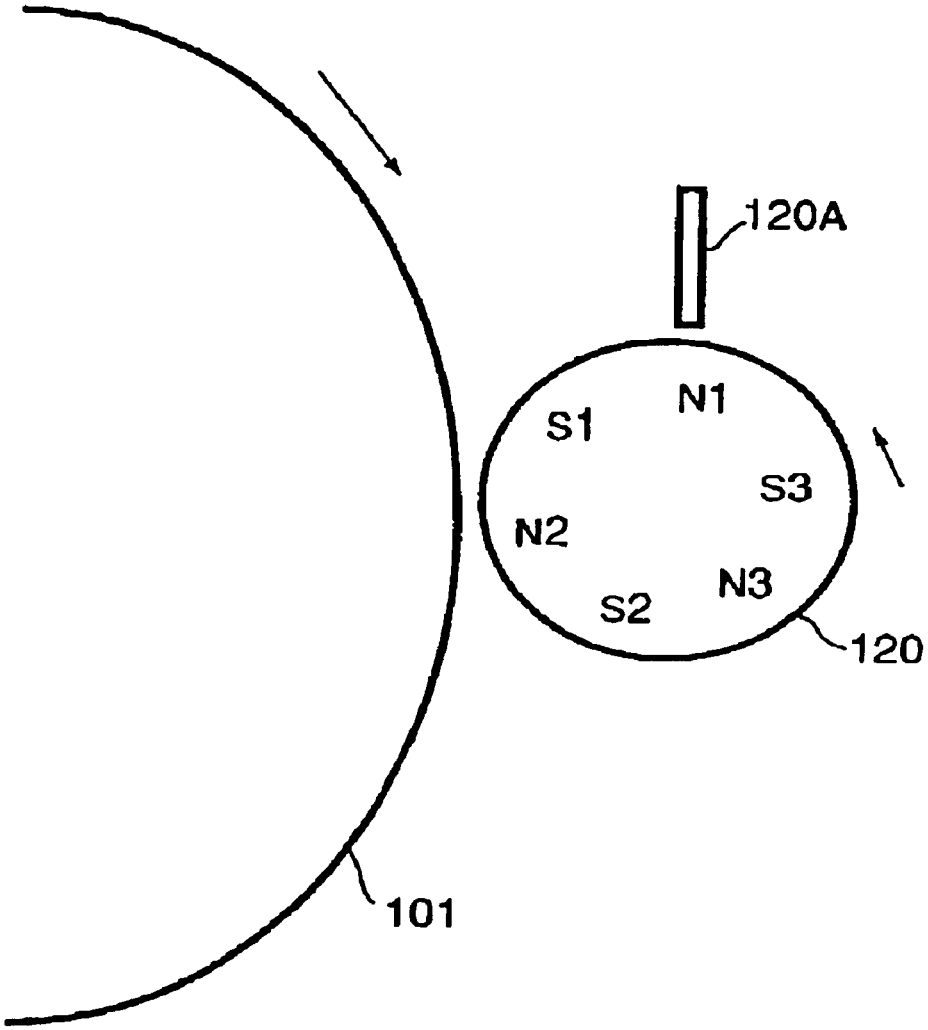
FIG. 14 is a schematic drawing for depicting the positioning of the magnetic poles of the magnetic member in the developer bearing member of the developing apparatus shown in FIG. 13.

The image forming apparatus in this embodiment is a digital copying machine employing the image forming system, shown in FIG. 11, which is 500 mm/sec in process speed and produces 110 copies per minutes. It comprises a photoconductive drum 1 as a latent image bearing member, which is an amorphous silicon type photoconductive drum.

In this image forming apparatus, the peripheral surface of the photoconductive drum 1 is uniformly charged by a primary charger 3 to a potential level of −700 V.

Then, the uniformly charged peripheral surface of the photoconductive drum 1 is exposed to a beam 12 of image exposure light at a resolution of 600 psi. The exposure beam 12 is a laser beam which has a wavelength of 680 $\mu$m, and is modulated in pulse-width with image formation signals, and the source of which is a semiconductor laser. As a result, an electrostatic latent image is formed on the peripheral surface of the photoconductive drum 1.

Next, the latent image is normally developed into a visual image, that is, a toner image, by a developing apparatus 2. The developing apparatus in this embodiment uses single-component negative magnetic toner with a particle diameter of 8.0 $\mu$m, as developer, and a jumping developing method, for the following reason: In the case of the conventional two-component developer, the carrier must be added for every 10,000 copies by service personnel. In other words, the use of the conventional two-component developer does not allow a developing apparatus to be free of maintenance, therefore allowing the merits of the toner recycling system to be only partially enjoyed. In comparison, in this embodiment, dry single-component magnetic toner, which has no limit in durability and is free of maintenance, is used. The development bias voltages for the upstream development sleeve 20 and downstream development sleeve 30 are both the combination of an AC bias voltage having a frequency of 2,400 Hz, a peak-to-peak voltage of 1,500 Vpp, and a duty ratio of 50%, and a DC voltage of +200 V. In this embodiment, the distance S-Bgap between the upstream development sleeve 20 and magnetic blade 20A is 250 $\mu$m, and the distances S-Dgap between the upstream development sleeve 20 and photoconductive drum 1, and between the downstream development sleeve 30 and photoconductive drum 1, are both 250 $\mu$m.

Thereafter, the above described toner image is charged by a post-charger 10 as a charging means; a total current of −200 $\mu$A is flowed. Then, it is transferred by a transfer charger 4 as a transferring means, onto a transfer medium as a recording medium being conveyed in the direction indicated by an arrow mark.

After the transfer of the toner image onto the transfer medium, the transfer medium is separated from the photoconductive drum 1 by a separation charger 5, and sent to a fixing apparatus 7, by which the tone image is fixed.

Meanwhile, the toner particles which remained on the photoconductive drum 1 after the image transfer are recovered (removed) from the photoconductive drum 1 by a cleaning apparatus 6 as a removing means, and are returned, as waste toner (reuse toner), to a developer hopper 9B through a conveyance pipe 8.

Within the conveyance pipe 8, a conveying member in the form of a screw is disposed. As this conveying member rotates, the reuse toner is conveyed toward the developer hopper 9B. After being conveyed to the developer hopper 9B by the conveying member in the conveyance pipe 8, the waste toner is placed in the developer hopper 9B, as shown in FIG. 11, to be reused. Further, a fresh supply of toner, which is separated from the reuse toner, is placed in the hopper 9A. Both toners are pulled inward of the hopper 9 by the magnetic rollers 24A and 24B, respectively, and as the magnetic rollers 24A and 24B rotate, the toners are conveyed into the developing apparatus 2. Incidentally, in this embodiment, the reuse toner and fresh toner are mixed within the developing apparatus. However, the hopper 9 may be provided with a mixing space, in which the reuse toner and fresh toner are mixed.

After being mixed in the developing apparatus 2, the mixed combination of the reuse and fresh toner is sent out to the upstream development sleeve 20 and downstream development sleeve 30 to be used for the development of the electrostatic latent image on the photoconductive drum 1. In this embodiment, the normal revolution of the magnetic roller 24A is twice per second, whereas the revolution of the magnetic roller 24B is varied at a predetermined ratio relative to the revolution of the magnetic roller 24A. In this embodiment, a piezoelectric sensor (product of TDK Co., Ltd.) is placed in the developing apparatus 2. As the toner weight is removed from the piezoelectric sensor by the toner consumption, the signal from the piezoelectric sensor begins to oscillate. Then, a toner supply signal is outputted to rotate the magnetic rollers 24A and 24B. Normally, the magnetic roller 24B is rotated at the 10/90 of the revolution of the magnetic roller 24B (revolution of magnetic roller 24A: revolution of magnetic roller 24B=9:1).

In this embodiment, the aforementioned distance d is 800 μm (d=800 μm). The magnetic force of the magnetic pole N2 (B) of the magnet 20B placed in the upstream development sleeve 20 is 80 mT, and the magnetic force of the magnetic pole S1 (C) of the magnet 30B placed in the downstream development sleeve 30 is 75 mT. The magnetic pole B, and the magnetic pole N1 (D) of the magnet 30B, which is aligned with the plane connecting the axial lines of the magnet 30B and photoconductive drum 1, or is placed in the adjacencies of this plane, are identical in polarity. The magnetic pole C is different in polarity from the magnetic poles B and D.

The magnetic poles A and B are on the inward side of the developing apparatus 2 (side opposite to photoconductive drum 1), with respect to the plane connecting the rotational axes of the upstream development sleeve 20 and downstream development sleeve 30. Further, the angle θ in FIG. 3(*a*) is 10°.

In thin embodiment, the relationship among the magnetic force [mT] of the magnetic pole B, magnetic force [mT] of the magnetic pole C, and distance d [μm] satisfies the following mathematic formula:

$$0.5 \geqq (80+75)/800 \geqq 0.2.$$

Therefore, the toner coat on the downstream development sleeve 30 remains stable.

Thus, according to this embodiment, it is possible to provide a small maintenance-free developing apparatus which uses single-component magnetic toner, is capable of reusing the waste toner, and yet is capable of uniformly coating developer on the peripheral surface of the upstream developer bearing members so that an image of high quality, in particular, in terms of density, can be always produced, and is smaller in toner consumption. In other words, it is possible to provide a compact developing apparatus suitable for a high speed print-on-demand apparatus employing a distributed developing system.

Embodiment 4

The basic structural arrangement of the developing apparatus in this embodiment is identical to that in the first embodiment.

Next, the developing apparatus 2 in this embodiment will be described in detail.

Figure 15:
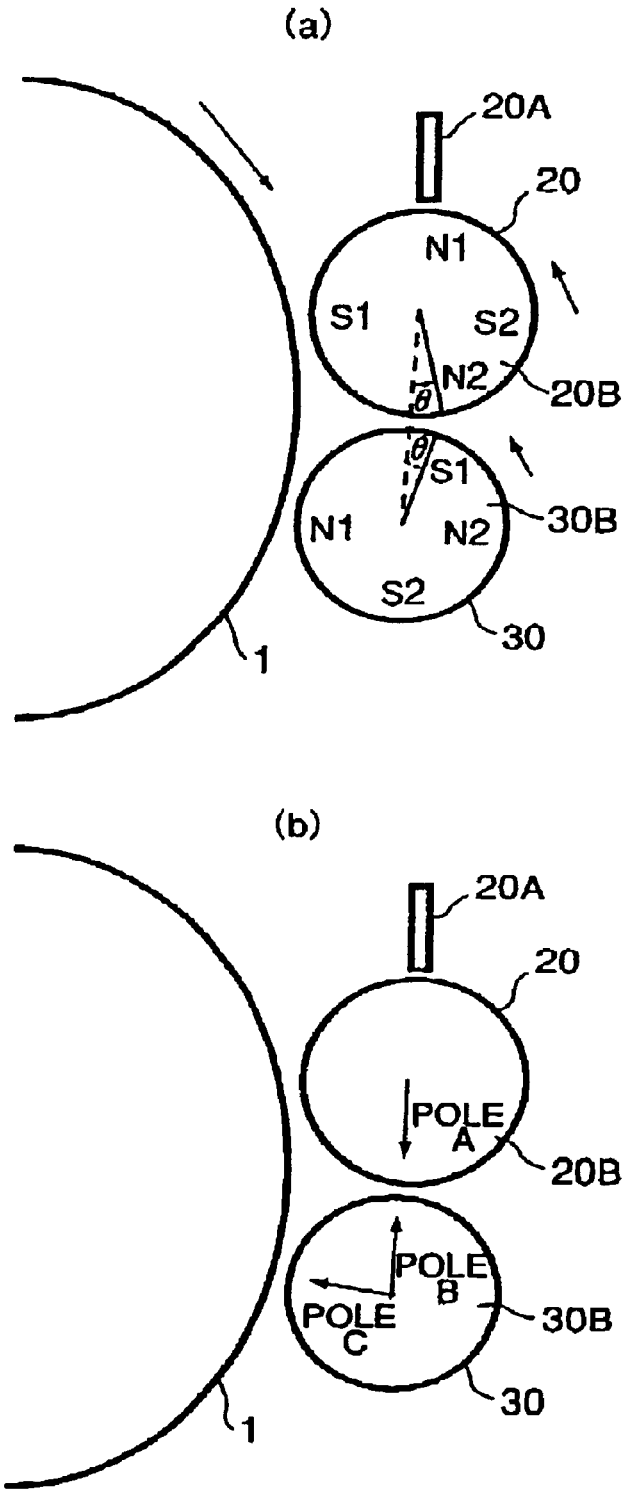
FIGS. 15(*a*) and 15(*b*) are a schematic drawings for depicting the positioning of the magnetic poles of the magnetic members in the developer bearing members of the developing apparatus.

Referring to FIG. 15(*a*), in the developing apparatus 2 in this embodiment, the upstream development sleeve 20 and downstream development sleeve 30 are disposed so that their peripheral surfaces are positioned closed to each other. They are rotated in the same direction (direction indicated by arrow marks).

First, the gist of the present invention will be described.

Regarding the developer flow caused by the peripheral surfaces of the developer bearing members, in the case of a developing apparatus, in accordance with the prior arts, which uses two-component developer, that is, a mixture of toner and carrier, the developer is passed from the upstream developer bearing member to the downstream developer bearing member, as shown in FIG. 4(*b*), at a location at which the distance between the peripheral surfaces of the upstream and downstream developer bearing members is smallest. In other words, the developer is conveyed by the portions of the development sleeves, on the latent image bearing member side. This is for the following reason. When two-component developer is used, toner. Is charged mainly by carrier. Therefore, developer has only to be conveyed by the developer bearing member to be supplied to the image bearing member.

However, when single-component magnetic developer is used, the primary contributor to the charging of developer is the developer bearing member. Therefore, not only must the developer be coated on the developer bearing member in a thin layer, but also must be sufficiently charged. Thus, the developer must be flowed on the downstream developer bearing member as shown in FIG. 4(*a*), being clearly different from the manner in which developer is flowed when two-component developer is used. In other words, not only must the developing apparatus convey developer to the latent image bearing member, but also charge the developer while uniformly coating the developer layer on the developer bearing member.

Thus, in this embodiment, the magnets are disposed so that their magnetic poles are positioned as shown in FIG. 15(*b*). That is, a magnetic pole A, as a first magnetic pole, of the magnet within the upstream development sleeve 20 is aligned with the plane connecting the axial lines of the upstream development sleeve 20 and downstream development sleeve 30, or is placed in the adjacencies of this plane, and a magnetic pole B, as a second magnetic pole, of the magnet within the upstream downstream development sleeve 30 is also aligned with the plane connecting the axial lines of the upstream and downstream development sleeves 20 and 30, or in the adjacencies of this plane. Further, a magnetic pole C of the magnet within the downstream development sleeve 30 is aligned with the plane connecting the axial lines of the downstream development sleeve 30 and photoconductive drum 1, or in the adjacencies of this plane.

The relationship among these magnetic poles are:

The magnetic poles A and B are on the inward side (side opposite to the photoconductive drum 1) of the developing apparatus 2, with respect to the plane connecting the rotational axes of the upstream development sleeve 20 and downstream development sleeve 30;

the magnetic poles A and C are identical in polarity, and the magnetic poles B is different in magnetic pole from the magnetic poles A and C;

the angle θ formed by the plane connecting the rotational axes of the upstream development sleeve 20 and downstream development sleeve 30 and the plane connecting the rotational axis of the upstream development sleeve 20 and magnetic pole A, and the angle θ formed by the plane connecting the rotational axes of the upstream development sleeve 20 and downstream development sleeve 30 and the plane connecting the rotational axis of the downstream development sleeve 30 and magnetic pole B, are no less than 0° and no more than 20°;

the relationship among the magnetic force [mT] of the magnetic pole A, magnetic force [mT] of the magnetic pole B, and distance d [μm] between the upstream development sleeve 20 and downstream development sleeve 30 satisfies the following mathematic formula:

$$0.5 \geqq (\text{magnetic force of magnetic pole } A + \text{magnetic force of magnetic pole } B)/d \geqq 0.2.$$

Regarding the angle θ, the plane connecting the rotational axes of the two sleeves corresponds to the value 0 of this angle θ. The positive and negative directions are the directions in which the magnetic poles A and B move away, or toward, the photoconductive drum 1 (FIG. 15(*a*)).

At this time, the relationship among the positions and polarities of the first, second, and third magnetic poles, and the distance between the upstream developer bearing member and downstream developer bearing member (which hereinafter will be referred to as the inter-developer bearing member distance), will be described.

Figure 16:
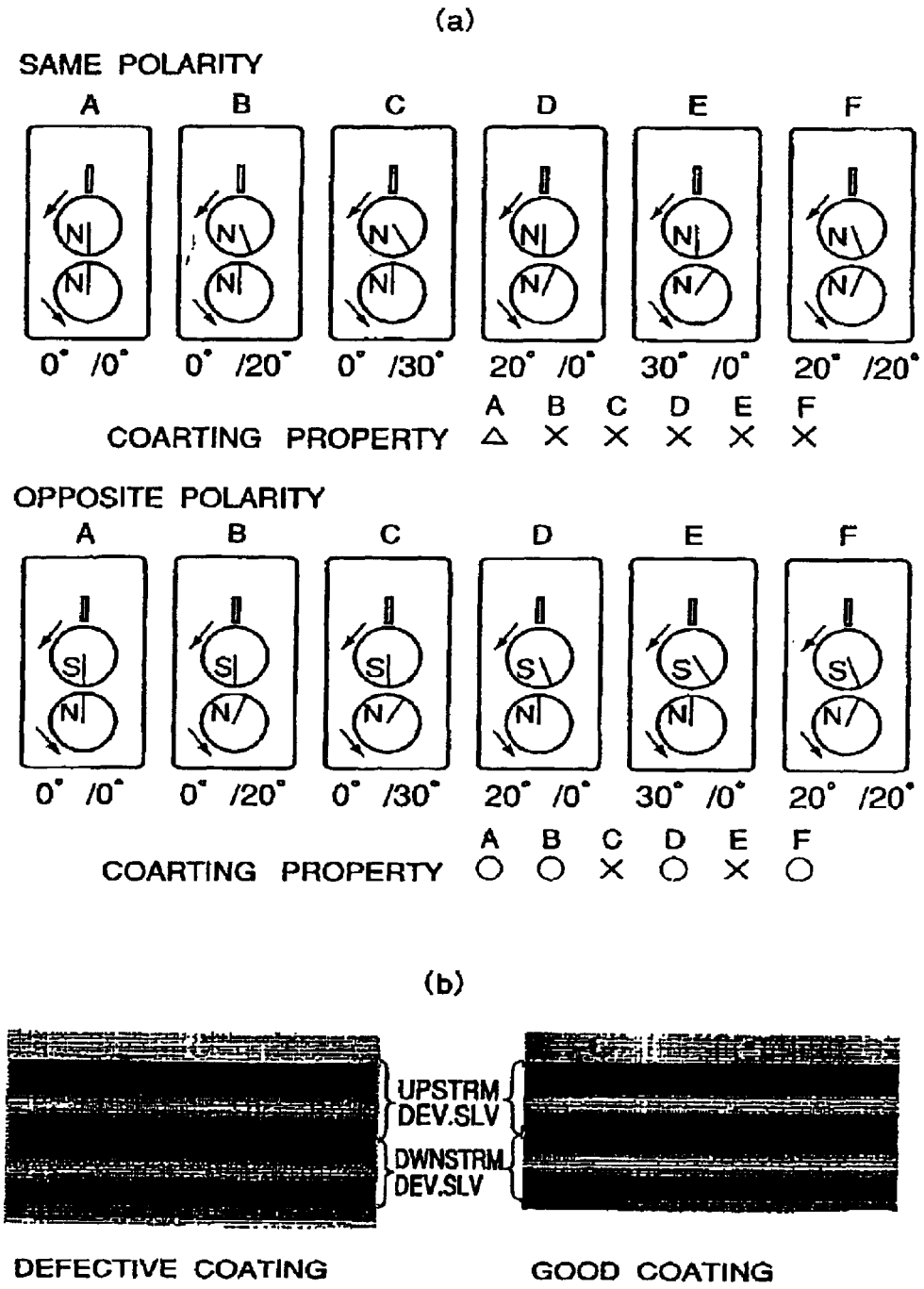
FIG. 16 is a schematic drawing for depicting the relationship among the positioning and polarity of the magnetic poles of the magnetic members of the developer bearing members, and the state of the developer coat on the downstream developer bearing member.

First, the positions and polarities of the first and second magnetic poles will be described. Here, the first and second magnetic poles were changed in position and polarity, as shown in FIG. 16(*a*), and the state of the developer coat on the downstream developer bearing member was examined. The magnetic forces of the first and second magnetic poles were both 70 mT.

The relationships between the first and second magnetic poles and the results of the examination of the state of the developer coat on the downstream developer bearing member are given in Table 8.

TABLE 8

| | Pole C | |
|---|---|---|
| Pole B | N | S |
| N | NG | G |
| S | G | NG |

N: No good
G: Good

The following may be concluded according to Table 8 and FIG. 16(*a*). That is, when the first and second poles were the same in polarity, a region in which the value of the magnetic force [mT] was "0" was created by the interaction of the two magnetic poles. In this region and its adjacencies, the gaps were formed among the developer particles on the peripheral surface of the downstream developer bearing member, making unstable the developer coat on the downstream developer bearing member.

On the contrary, when the mutually opposing magnetic poles were made different in polarity, the magnetic field was strengthened in the region in which the two magnetic poles oppose each other, making stable the developer coat on the peripheral surface of the downstream developer bearing member.

Table 9 shows the relationships among the state of the developer coat on the downstream developer bearing member, and the positions of the first and second magnetic poles (angle formed by the plane connecting the rotational axes of the upstream developer bearing member and downstream developer bearing member and the plane connecting the rotational axis of the upstream developer bearing member and first magnetic pole, and angle formed by the plane connecting the rotational axes of the upstream developer bearing member and downstream developer bearing member and the plane connecting the rotational axis of the downstream developer bearing member and second magnetic pole).

TABLE 9

| | POLE B | | |
|---|---|---|---|
| POLE A | −20°–0° | 0°–20° | 20°–40° |
| −20°–0° | NG | NG | NG |
| 0°–20° | NG | G | NG |
| 20°–40° | NG | NG | NG |

G: Good
NG: No good

According to Table 9 and FIG. 16(*a*), when the distance between the first and second magnetic poles was greater than a certain value, the state of the developer coat on the downstream developer bearing member was unsatisfactory. The reason for this result may be thought to be that as the distance between first and second magnetic poles was increased, the developer confining force deriving from the magnetic forces from the magnetic poles was reduced by an amount equal to the square of the distance between the two poles. In other words, it is reasonable to think that the positioning of the first and second magnetic poles is one of the essential factors which affects the state of the developer coat on the downstream developer bearing member.

Thus, the following may be concluded from FIG. 16(*a*), and Tables 8 and 9. That is, the developer coat on the downstream developer bearing member can be stabilized by making the first and second magnetic poles different in polarity, and positioning them so that the angle formed by the plane connecting the rotational axes of the upstream developer bearing member and downstream developer bearing member and the plane connecting the rotational axis of the upstream developer bearing member and first magnetic pole, and the angle formed by the plane connecting the rotational axes of the upstream developer bearing member and downstream developer bearing member and the plane connecting the rotational axis of the downstream developer bearing member and second magnetic pole, fall within a range of 0°–20°. However, where the above angle was within a range of 5°–0°, the state of the developer coat was merely acceptable (because in reality, there is always play in a mechanical system). Thus, in order to really stabilize the developer coat, the above angles are desired to be no less than 0° and no more than 20°.

Further, the state of the developer coat on the downstream developer bearing member was also examined in relation to the strength of the magnetic forces of the first and second magnetic poles, which were varied from 40 mT to 110 mT. The results of the examination of the relationships among the state of the developer coat on the downstream developer bearing member and the positions of the first and second magnetic poles were identical to those in Table 9. Further, the state of the developer coat on the downstream developer bearing member was examined in relation to the toner diameter, which was varied in a range of 6–10 μm. The results were also the same.

Next, the relationship between the second and third magnetic poles will be described.

When the second and third magnetic poles are the same in polarity, a region in which magnetic force is absent is created on the peripheral surface of the downstream developer bearing member, between the plane connecting the rotational axes of the upstream developer bearing member and downstream developer bearing member, and the point corresponding to the development pole (magnetic forces from second and third magnetic poles cancel each other), making it difficult for developer to be conveyed.

Therefore, the first and third magnetic pole are made the same in polarity, whereas the second magnetic pole is made different in polarity from the first and third magnetic poles.

Next, the relationship between the state of the developer coat on the downstream developer bearing member and the first and second magnetic poles, and the inter-developer bearing member distance d [μm], will be described.

It was discovered that as far as the magnetic poles A and B were concerned, the state of the developer coat on the downstream developer bearing member was correlated to the inter-developer bearing member distance d [μm].

First, in order to make and keep uniform the developer coat on the downstream developer bearing member, the developer confining force created by the magnetic forces from the magnetic poles between the upstream developer bearing member and downstream developer bearing member must be greater than a certain value. However, if this developer confining force deriving from the magnetic poles is greater by an excessive amount than the certain value, the developer bearing members themselves are deformed, sometimes making the difference between the inter-developer bearing member distance across the center portions of the two developer bearing members, and that at the end portions of the two developer bearing members, no less than 100 μm.

Thus, tests regarding the above two concerns were carried out, in which the strengths of the magnetic forces of the first and second magnetic poles, and inter-developer bearing member distance d were varied, as shown in Table 10, and the state of the developer coat, and the extent of the developer bearing member deformation, were evaluated.

TABLE 10

| | POLE B | | | | | | | |
|---|---|---|---|---|---|---|---|---|
| POLE A | 40 mT | 50 mT | 60 mT | 70 mT | 80 mT | 90 mT | 100 mT | 110 mT |
| (d = 200 μm) | | | | | | | | |
| 40 mT | G | G | G | NG | NG | NG | NG | NG |
| 50 mT | G | G | NG | NG | NG | NG | NG | NG |
| 60 mT | G | NG | NG | NG | NG | NG | NG | NG |
| 70 mT | NG | NG | NG | NG | NG | NG | NG | NG |
| 80 mT | NG | NG | NG | NG | NG | NG | NG | NG |
| 90 mT | NG | NG | NG | NG | NG | NG | NG | NG |
| 100 mT | NG | NG | NG | NG | NG | NG | NG | NG |
| 110 mT | NG | NG | NG | NG | NG | NG | NG | NG |
| (d = 300 μm) | | | | | | | | |
| 40 mT | G | G | G | G | G | G | G | G |
| 50 mT | G | G | G | G | G | G | G | NG |
| 60 mT | G | G | G | G | G | G | NG | NG |
| 70 mT | G | G | G | G | G | NG | NG | NG |
| 80 mT | G | G | G | G | NG | NG | NG | NG |
| 90 mT | G | G | G | NG | NG | NG | NG | NG |
| 100 mT | G | G | NG | NG | NG | NG | NG | NG |
| 110 mT | G | NG | NG | NG | NG | NG | NG | NG |
| (d = 400 μm) | | | | | | | | |
| 40 mT | G | G | G | G | G | G | G | G |
| 50 mT | G | G | G | G | G | G | G | G |
| 60 mT | G | G | G | G | G | G | G | G |
| 70 mT | G | G | G | G | G | G | G | G |
| 80 mT | G | G | G | G | G | G | G | G |
| 90 mT | G | G | G | G | G | G | G | G |
| 100 mT | G | G | G | G | G | G | G | NG |
| 110 mT | G | G | G | G | G | G | NG | NG |
| (d = 600 μm) | | | | | | | | |
| 40 mT | NG | NG | NG | NG | G | G | G | G |
| 50 mT | NG | NG | NG | G | G | G | G | G |
| 60 mT | NG | NG | G | G | G | G | G | G |
| 70 mT | NG | G | G | G | G | G | G | G |
| 80 mT | G | G | G | G | G | G | G | G |
| 90 mT | G | G | G | G | G | G | G | G |
| 100 mT | G | G | G | G | G | G | G | G |
| 110 mT | G | G | G | G | G | G | G | G |
| (d = 800 μm) | | | | | | | | |
| 40 mT | NG | NG | NG | NG | NG | NG | NG | NG |
| 50 mT | NG | NG | NG | NG | NG | NG | NG | G |
| 60 mT | NG | NG | NG | NG | NG | NG | G | G |
| 70 mT | NG | NG | NG | NG | NG | G | G | G |
| 80 mT | NG | NG | NG | NG | G | G | G | G |
| 90 mT | NG | NG | NG | G | G | G | G | G |
| 100 mT | NG | NG | G | G | G | G | G | |
| 110 mT | NG | G | G | G | G | G | G | G |
| (d = 1000 μm) | | | | | | | | |
| 40 mT | NG | NG | NG | NG | NG | NG | NG | NG |
| 50 mT | NG | NG | NG | NG | NG | NG | NG | NG |
| 60 mT | NG | NG | NG | NG | NG | NG | NG | NG |
| 70 mT | NG | NG | NG | NG | NG | NG | NG | |
| 80 mT | NG | NG | NG | NG | NG | NG | NG | NG |
| 90 mT | NG | NG | NG | NG | NG | NG | NG | G |
| 100 mT | NG | NG | NG | NG | NG | NG | G | G |
| 110 mT | NG | NG | NG | NG | NG | G | G | G |
| (d = 1200 μm) | | | | | | | | |
| 40 mT | NG | NG | NG | NG | NG | NG | NG | NG |
| 50 mT | NG | NG | NG | NG | NG | NG | NG | NG |
| 60 mT | NG | NG | NG | NG | NG | NG | NG | NG |
| 70 mT | NG | NG | NG | NG | NG | NG | NG | NG |
| 80 mT | NG | NG | NG | NG | NG | NG | NG | NG |

TABLE 10-continued

| | POLE B | | | | | | | |
|---|---|---|---|---|---|---|---|---|
| POLE A | 40 mT | 50 mT | 60 mT | 70 mT | 80 mT | 90 mT | 100 mT | 110 mT |
| 90 mT | NG | NG | NG | NG | NG | NG | NG | NG |
| 100 mT | NG | NG | NG | NG | NG | NG | NG | NG |
| 110 mT | NG | NG | NG | NG | NG | NG | NG | NG |

Regarding the evaluation codes in Table 10, when the difference between the inter-developer bearing member distance across the center portions of the two members and that at the end portions of the two members, in terms of the axial direction of the two members, is no more than 50 μm, a referential sign was given, and when the difference was no less than 50 μm, a referential sign was given. In order to prevent the developer from stagnating between the upstream developer bearing member and downstream developer bearing member, and the agglomerated developer from blocking the gap between the upstream developer bearing member and downstream developer bearing member, the inter-developer bearing member distance d [μm] is desired to be no less than 200 μm. Therefore, the tests were conducted varying the inter-developer bearing member distance d [μm], starting from 200 μm to 1,200 μm, above which all evaluations would have been NG. On the other hand, regarding the evaluation signs for the state of the developer coat on the downstream developer bearing member, when it was excellent, being uniform, a referential sign G was given, and when it was not good, being nonuniform, a referential sign NG was given; in other words, it was evaluated in binary fashion, as shown in FIG. 5(*b*). The state of the developer coat was judged after the actual production of 10,000 copies.

It is evident from the evaluations in Table 10 that in view of the value obtained by dividing the sum of the absolute values of the strengths of the first and second magnetic poles, by the inter-developer bearing member distance d [μm], there is a certain law in the relationship between the state of the developer coat and the strengths of the first and second magnetic poles. In other words, when this value is no less than 0.2, the developer confining magnetic force deriving from the first and second magnetic poles is large enough to uniformly coat a sufficient amount of developer on the downstream developer bearing member. As for the upper limit of this value, as long as this value is no more than 0.5, the amount of the deformation of the developer bearing members remains insignificant, making it possible for the developer bearing members to uniformly coat the developer.

In other words, the following are evident as the conditions for stabilizing the developer coat on the downstream developer bearing member. That is, the developer coat on the downstream developer bearing member can be stabilized by making the first and third magnetic poles the same in polarity, and the second magnetic pole different in polarity from the first and third magnetic poles, and positioning them so that:

(1) the angle formed by the plane connecting the rotational axes of the upstream developer bearing member and downstream developer bearing member and the plane connecting the rotational axis of the downstream developer bearing member and first magnetic pole, and the angle formed by the plane connecting the rotational axes of the upstream developer bearing member and downstream developer bearing member and the plane connecting the rotational axis of the downstream developer bearing member and second magnetic pole, fall within a range of 0°–20°; and (2) the relationship among the magnetic force [mT] of the first magnetic pole, magnetic force [mT] of the second magnetic pole, and inter-developer bearing member distance d [μm] satisfies the following mathematic formula:

$$0.5 \geqq (\text{magnetic force of first magnetic pole} + \text{magnetic force of second magnetic pole})/d \geqq 0.2.$$

In this embodiment, the angle (θ in FIG. 15(*a*)) formed by the plane connecting the rotational axes of the upstream development sleeve 20 and downstream development sleeve 30, and the plane connecting the rotational axis of the upstream development sleeve 20 and the magnetic pole A, and the angle (θ in FIG. 15(*a*)) formed by the plane connecting the rotational axes of the upstream development sleeve 20 and downstream development sleeve 30, and the plane connecting the rotational axis of the downstream development sleeve 30 and the magnetic pole B, are both set to 5°. Further, tests similar to the above described ones were carried out, with this angle θ varied within a range of 0–20. Quantitatively, there were no significant differences.

The positioning of the magnetic poles in the upstream development sleeve 20 and downstream development sleeve 30, and the specifications of the magnets in the upstream development sleeve 20 and downstream development sleeve 30, in this embodiment, are given in Table 11 and 12, respectively.

TABLE 11

| | MAG. FORCE (G) | ANGLE (deg.) | HALF-PEAK WIDTH (deg.) |
|---|---|---|---|
| N1 | 900 | 0 | 40 |
| N2 | 800 | 100 | 40 |
| S1 | 1000 | 170 | 40 |
| S2 | 600 | 270 | |

TABLE 12

| | MAG. FORCE (G) | ANGLE (deg.) | HALF-PEAK WIDTH (deg.) |
|---|---|---|---|
| N1 | 1000 | 85 | 40 |
| N2 | 700 | 270 | 40 |
| S1 | 750 | −5 | 40 |
| S2 | 600 | 180 | |

Referring to FIG. 6, the upstream development sleeve 20 is a stainless steel (SUS305) cylinder, that is, a nonmagnetic member, with a diameter of 20 mm. The peripheral surface of which has been blasted with FGB #600, and then, has been coated.

Within the hollow of the upstream development sleeve 20, a magnet 20B as a magnetic member having a magnetic field pattern shown in FIG. 15(*a*) and Table 11 is stationarily disposed. The upstream development sleeve 20 is rotated at the 150% of the peripheral velocity of the photoconductive drum 1.

The toner particle layer on the upstream development sleeve 20 are regulated in thickness by a magnetic blade 20A In this embodiment, the distance S-Bgap between the upstream development sleeve 20 and magnetic blade 20A is 250 μm.

The distance S-Dgap between the upstream development sleeve 20 and photoconductive drum 1 is 200 μm. In this embodiment, a latent image is developed by applying to the upstream development sleeve 20 the combination of a DC bias voltage of +300 V, and an AC bias voltage having the rectangular waveform shown in FIG. 7, a peak-to-peak voltage of 1,200 Vpp, and a frequency of 2.5 kHz, with the use of a bias applying means (unshown), and single-component magnetic developer, without placing the upstream development sleeve 20 in contact with the photoconductive drum 1. Thus, the development contrast, which causes toner particles to jump from the upstream development sleeve 20 to the photoconductive drum 1, is 200 V and the fog prevention contrast is 150 V.

The downstream development sleeve 30 is similar to the upstream development sleeve 20. It is a stainless steel (SUS305) cylinder, that is, a nonmagnetic member, with a diameter of 20 mm. Its peripheral surface has been blasted with FGB #600; it has a surface roughness Rz of 3 μm. The surface roughness Rz was measured using a contact surface roughness gauge (Surfcorder SE-3300 of Kosaka Lab., Ltd.). As for the measurement conditions, the cutoff value was 0.8 mm; measurement length, 2.5 mm; feeding speed: 0.1 mm/sec; and magnification was 5,000×.

Within the hollow of the downstream development sleeve 30, a magnet 30B as a magnetic member is stationarily disposed, which has four magnetic poles positioned as shown in FIG. 3(*a*), and the specifications (magnetic field pattern) of which are given in Table 12.

To the downstream development sleeve 30, a DC bias voltage of +300, and an AC voltage having the rectangular waveform shown in FIG. 7, a peak-to-peak voltage of 1,200 Vpp, and a frequency of 2.5 kHz, can be applied in combination. In this embodiment, the development bias voltage applied to the downstream development sleeve 30 is identical to the development bias voltage applied to the upstream development sleeve 20. Therefore, cost can be reduced by making a structural arrangement so that a single power source can be shared by the bias applying means for the upstream development sleeve 20 and bias applying means for the downstream development sleeve 30. Such an arrangement reduces the space necessary for the power source, contributing to special efficiency.

The downstream development sleeve 30 is rotated at the 150% of the peripheral velocity of the photoconductive drum 1.

The toner particle layer on the peripheral surface of the downstream development sleeve 30 is regulated in thickness by the upstream development sleeve 20. In this embodiment, the distance S-Dgap between the peripheral surfaces of the downstream development sleeve 30 and photoconductive drum 1 is 250 μm.

In this embodiment, the distance d between the upstream development sleeve 20 and downstream development sleeve 30 is 400 μm. The magnetic force of the magnetic pole N2 (A) of the magnet 20B placed in the upstream development sleeve 20 is 80 mT, and the magnetic force of the magnetic pole S1 (B) of the magnet 30B placed in the downstream development sleeve 30 is 75 mT. The magnetic pole A, and the magnetic pole N1 (C) of the magnet 30B, which is aligned with the plane connecting the axial lines of the magnet 30B and photoconductive drum 1, or is placed in the adjacencies of this plane, are identical in polarity. The magnetic pole B is different in polarity from the magnetic poles A and C.

The magnetic poles A and B are on the inward side of the developing apparatus 2 (side opposite to photoconductive drum 1), with respect to the plane connecting the rotational axes of the upstream development sleeve 20 and downstream development sleeve 30. Further, the angle θ in FIG. 15(*a*) is 10°. In other words, the angle formed by the plane connecting the rotational axes of the upstream development sleeve 20 and downstream development sleeve 30 and the plane connecting the rotational axis of the upstream development sleeve 20 and magnetic pole A, and the angle formed by the plane connecting the rotational axes of the upstream development sleeve 20 and downstream development sleeve 30 and the plane connecting the rotational axis of the downstream development sleeve 30 and magnetic pole B, is no less than 0° and no more than 20°.

In this embodiment, the relationship among the magnetic force [mT] of the magnetic pole A, magnetic force [mT] of the magnetic pole B, and distance d [μm] between the upstream development sleeve 20 and downstream development sleeve 30 satisfies the following mathematic formula:

$$0.5 \geqq (80+75)/400 > 0.2.$$

Therefore, the toner coat on the downstream development sleeve 30 is stabilized and remains stable.

Referring to FIG. 8(*a*), the upstream development sleeve 20 contains the magnet 20B with four magnetic poles, and the downstream development sleeve 30 contains the magnet 30B with four magnetic poles. Referring to FIG. 8(*b*), there is a magnetic sealing member 2D at each end of the upstream development sleeve 20 and downstream development sleeve 30 in terms of lengthwise direction. The magnetic sealing member 2D is formed of MOLDALLOY (KN plated; 10.6 in permeability), the main component of which is iron, and is shaped to conform to the contour of the peripheral surface of each development sleeve. The gaps between the magnetic sealing member 2D and upstream development sleeve 20, and between the magnetic sealing member 2D and downstream development sleeve 30, are both 400 μm±100 μm.

In this embodiment, the lengths L1 and L2 of the magnets 20B and 30B, respectively, in terms of the axial direction of the upstream development sleeve 20 and downstream development sleeve 30 are 305 mm and 305, respectively.

As for the optimal positioning of the magnetic sealing members 2D relative to the magnets 20B and 30B in terms of the axial directions of the upstream development sleeve 20 and downstream development sleeve 30, it is desired that the magnetic sealing members 2D are positioned so that the outward end surface of each magnetic sealing member 2D aligns with the end surface of the corresponding lengthwise end of the corresponding magnet. This is for the following reason. If the magnets 20B and 30B extends beyond the outward end of the corresponding magnetic sealing member 2D, in terms of the axial directions of the two magnets 20B and 30B, magnetic force will be present beyond the end of the magnet (in terms of the above described axial directions). Therefore, some of the toner will be displaced outward beyond the magnetic sealing member 2D, by this magnetic force, and will eventually leak. In principle, the magnetic sealing members 2D are for forming magnetic brushes between themselves and the magnets 20B and 30B for the purpose of toner leak prevention. However, if the magnetic sealing member 2D is positioned so that the end surface of the corresponding magnet is positioned inward of the developing apparatus, in terms of the axial direction of the magnet, with respect to the magnetic sealing member 2D, a magnetic brush having a width equal to that of the magnetic sealing member 2D is formed on the portion of the corresponding development sleeve, on the outward side, with respect to the outward end surf ace of the corresponding magnet in terms of the axial direction of the magnet, in spite of the absence of the magnetic force from the magnet. Therefore, if the distance between the sealing member 2D and the outward end surface of the corresponding magnet is substantial when the magnetic sealing member 2D is positioned so that the end surface of the corresponding magnet is positioned inward of the developing apparatus, in terms of the axial direction of the magnet, with respect to the magnetic sealing member 2D, the toner particles on the portion of the development sleeve, on the outward side, with respect to the outward end surface of the magnet in terms of the axial direction of the magnet, leak from the lengthwise end of the developing apparatus, and also, the toner particle layers on the upstream development sleeve 20 and downstream development sleeve 30 become thick, sometimes allowing the toner particles to fall off in agglomeration. In this embodiment, in consideration of the presence of a certain amount of play in terms of the above described lengthwise direction among the upstream development sleeve 20, downstream development sleeve 30, magnet 20B, and magnet 30B, each magnetic sealing member 2D is disposed so that its outward end surface is positioned 1 mm inward of the corresponding end surface of the magnet 20B or 30B in terms of the axial directions of the magnets 20B or 30B, as shown in FIG. 8(*b*).

Next, the image forming process in this embodiment will be described.

In this embodiment, the image formation data are processed in the following manner by an image signal controlling portion, shown in FIG. 9; they are converted into binary data using the dither method.

Referring to FIG. 9, an image processing portion 201 processes the inputted image signals, based on the instruction given by an operator; for example, it changes resolution.

A γ correction portion 202 corrects the image signals in terms of the gamma by referring to a lookup table (LUT) created by a LUT calculating portion 205.

A binary conversion portion 203 generates signals for driving the laser, based on the image signals corrected in the gamma.

Then, a laser 204 is driven by the driving signals outputted from the binary conversion portion 203, and emits a beam 12 of image exposure light in accordance with the above described image signals corrected in the gamma. In this embodiment, the lookup table is created in the γ correction portion 202 by the LUT calculating portion 205 so that the lookup table matches the development contrast in the operational environment in which the image forming apparatus is operated.

As described above, in this embodiment, not only is correction made for the development contrast, but also for gradation (for example, γ correction or the like). Then, the lookup table for the γ correction portion 202 is refreshed so that the corrected gradation effects an ideal tone reproduction curve (TRC).

The effects of the present invention obtained when a latent image formed on a negatively chargeable photoconductive drum is developed using positively chargeable toner are the same as those obtained when a latent image formed on a negatively chargeable photoconductive drum is developed using negatively chargeable toner.

In this embodiment, development bias voltage comprising an AC component is applied to the developer bearing members. Therefore, if an excessive amount of toner is adhered to the peripheral surface of the photoconductive drum 1 by the upstream development sleeve 20, the excessive portion can be recovered into the developing apparatus 2 by the downstream development sleeve 30, contributing to the reduction in toner consumption. The measured toner consumption per copy (6% in image ratio) was 50–60 mg/copy for a conventional developing apparatus employing single-component magnetic developer, and 41 mg/copy for the developing apparatus this embodiment.

In other words, according to this embodiment, it is possible to provide a small maintenance-free developing apparatus, which is capable of uniformly and reliably coating developer on the upstream developer bearing member so that an image of high quality, in particular, in terms of density, can be reliably produced, and yet is smaller in toner consumption. In other words, it is possible to provide a compact developing apparatus suitable for a high speed print-on-demand apparatus employing a distributed developing system.

Embodiment 5

Next, the fifth embodiment of the present invention will be described. The structural arrangements in this embodiment similar to those in the fourth embodiment will be not described.

Generally speaking, if a development sleeve is a bare cylinder of stainless steel or aluminum, it is difficult to control the triboelectrical charge of the developer. Therefore, in this embodiment, in consideration of this fact, the upstream development sleeve and downstream development sleeve are coated with a substance optimal for controlling the triboelectrical charge of the toner by the upstream development sleeve as an upstream developer bearing member, and the downstream development sleeve as a downstream developer bearing member, and single-component magnetic toner, which normally becomes negatively charged, is used.

Further, in consideration of toner conveyance, the magnet in the upstream development sleeve is given five magnetic poles to creating in the developing apparatus, a magnetic field which repels toner from the peripheral surface of the upstream development sleeve, so that the agglomerates of toner particles are repelled from the peripheral surface of the upstream development sleeve while they are in this toner repelling field, to reduce the amount of the toner particles remaining stuck on the same spots of the peripheral surface of the upstream development sleeve and rotating therewith. The coating of the peripheral surface of the base member of the development sleeves is for preventing the generation of the sleeve ghost which is generated in synchronism with the rotational cycle of the development sleeve, which is one of the problems pointed out in Japanese Laid-open Patent Application 3-36570 and the like, and also to increase the durability of the development sleeve in terms of surface properties (it in a film for protecting aluminum surface). Incidentally, in this embodiment, the inter-development sleeve distance d is 600 μm.

The image forming apparatus in this embodiment employs an amorphous silicon based photoconductive drum having a diameter of 108 mm, as an image bearing member. It is a black-and-white digital copying machine, like the one in the first embodiment, which is 470 mm/sec in process speed and produces 90 copies per minute. The developer in this embodiment is negatively chargeable toner with a weight-average particle diameter of 7.5 μm, and contains $SiO_2$, as external additive which coats the toner particles, by 1.0 wt. %.

The formula of the coating of the development sleeve is created by mixing crystalline graphite and carbon into phenol resin. The mixture is coated on the peripheral surface of the aluminum cylinder so that 10 μm thick film is formed as the coated mixture is cured in an environment in which temperature is 50° C. In order for the film to be uniform and stable, its thickness is desired to be approximately 20 μm. In this case, P/B ratio is 1/2.5 (B stands for weight of resin, and P stands for weight of ingredients other than P (crystalline graphite+carbon)).

When the toner coating amount on the downstream developing sleeve is regulated by the upstream developing sleeve as in this embodiment, the use is made with phenolic resin containing 70 parts by weight quaternary ammonium salt only for the downstream developing sleeve since otherwise, the charging particularly property relative to the negative property toner is too high.

When the quaternary ammonium salt compound is added, it is uniformly dispersed in the phenolic resin, and when the phenolic resin is formed into a coating by heating curing, the quaternary ammonium salt is taken in the structure of the phenolic resin with the result that phenolic resin composition acquires a negative charging property. Therefore, the developer can be conveniently charged to the positive polarity, if the developer carrying member having a coating layer of the above-described material is used.

Examples of the quarternary ammonium salts having the preferable function include the following:

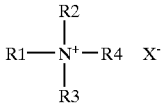

Wherein R1, R2, R3 and R4 each represent an alkyl group which may have a substituents, aryl group which may have a substituent, or an aralkyl group, and R1–R4 may be the same or different. $X^-$ represents anion of acid.

In this general formula, specific examples of the acid ion $X^-$ include organic sulfate ion, organic sulfonate ion, organic phosphate ion, molybdate ion, tungstate ion, and heteropolyacid including molybdenum atom or tungsten atom, or the like.

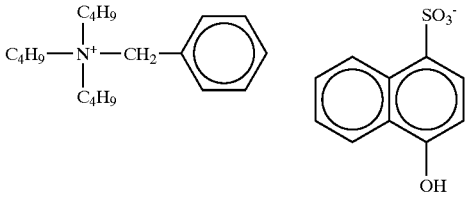

When the coating layer is formed using a resin material composition of a phenolic resin added with a quarternary ammonium salt compound, as shown above, the quarternary ammonium salt compound is taken into the phenolic resin when the phenolic resin which is the binder resin is heat-cured into the coating layer. Therefore, as contrasted to the above-described material added with the negative property silica particles or negative property. Teflon particles or the like, the positive triboelectric charging performance relative to the positive chargeable developer is enhanced over the entire coating layer. In addition, as contrasted to the coating of the particle addition type, the process property is not deteriorated, or the strength of the coating layer is not deteriorated.

Examples of the quarternary ammonium salt compound preferably usable with the present invention include the following which however does not limit the present invention.

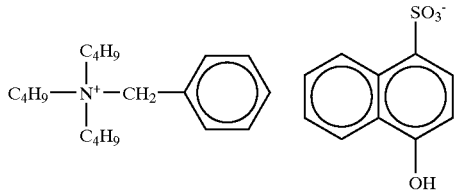

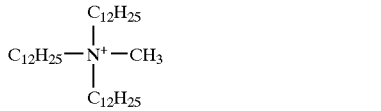

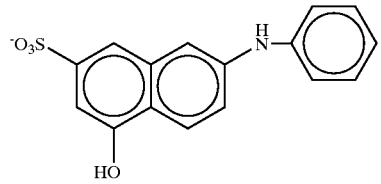

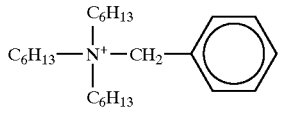

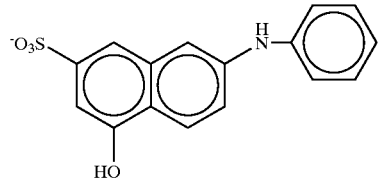

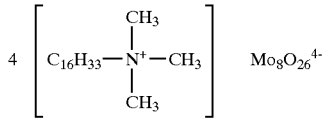

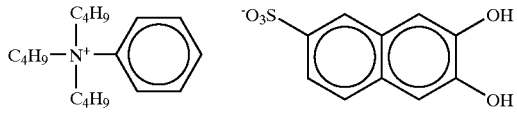

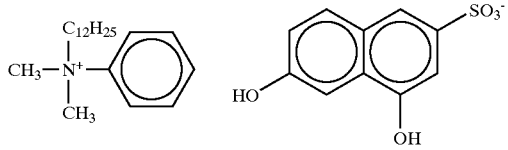

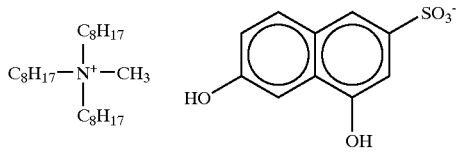

-continued

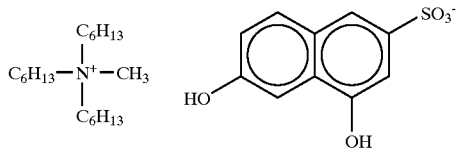

As for the phenolic resin constituting the binder resin used in the present invention, if the one which used a nitrogen-containing compound as a catalyst in the manufacturing step, is used, the quarternary ammonium salt compound is relatively easily taken into the structure of the phenolic resin particularly during the heating curing. Therefore, it is preferable to use from the standpoint of preventing charge-up of the toner. In this invention, such a phenolic resin produced using a nitrogen-containing compound catalyst in the manufacturing step, is used as one of the materials of the coating layer on the developer carrying member, the developing device in which the toner charge-up is prevented can be provided.

Examples of the nitrogen-containing compound usable as the catalyst in the manufacturing step of the phenolic resin, for example, ammonium salt such as ammonium sulfate, ammonium phosphate, ammonium sulfaminate, ammonium carbonate, ammonium acetate, ammonium maleate, or amine salt, as acidic catalysts; ammonia, and amino compounds such as dimethylamine, diethylamine, diisoproplylamine, diisobutylamine, diamylamine, trimethylamine, triethylamine, tri-n-butylamine, triamylamine, dimethylbenzylamine, diethylbenzylamine, dimethylaniline, diethylaniline, N,N-di-n-butylaniline, N,N-di-amylaniline, N,N-di-t-amylaniline, N-methylethanolamine, N-ethylethanolamine, diethanolamine, triethanolamine, dimethylethanolamine, diethylethanolamine, ethyldiethanolamine, n-butyldiethanolamine, di-n-butylethanolamine, triisopropanolamine, ethylenediamine and hexamethylenetetramine; and nitrogen-containing heterocyclic compound, as basic catalyst. The nitrogen-containing hetrocyclic compound may include pyridine and derivative thereof such as pyridine, α-picoline, β-picoline, γ-picoline, 2,4-lutidine or 2,6-lutidine; quinoline compound; and imidazole and the derivative thereof such as imidazole, 2-methylimidazole, 2,4-di-methylimidazole, 2-ethyl-4-methylimidazole, 2-phenylimidazole, 2-phenyl-4-methylimidazole and 2-heptadecylimidazole.

In the present invention, in order to adjust the resistance value of the coating layer to said value, it is preferable to contain the following electroconductive material in the coating layer. The electroconductive material are, for example, metal powder members of aluminum, copper, nickel, silver and so on, metal oxide such as oxide antimony, oxide indium, tin oxide and so on, carbide such as carbon fiber, carbon black, graphite and so on. Among them, carbon black, inter alia amorphous carbon was used in this invention, because it is excellent in the electroconductivity, because the electroconductivity can be given by adding in the polymeric material and because any electroconductivities can be quite freely provided only by adjusting the amount thereof.

In this embodiment, the prescription of the film was:

phenolic resin: 250 parts by weight;

graphite having an average particle size of 7.5 μm: 90 parts by weight;

carbon: 10 parts by weight; and quarternary ammonium: 70 parts.

As regards the ratio of the graphite and carbon contents, it is preferable that content of the graphite is not less than 3 times the content of the carbon, in order to stabilize the resistance of the entirety of the film. The coating is provided on the developing sleeve by spray method and drying at 150° for 30 min.

By the optimization of the coating, according to this embodiment, the triboelectric charge (charge amount) is 9 μC/g on the upstream developing sleeve, and 9.2 μC/g on the downstream developing sleeve, which are substantially the same, although the amount of triboelectric charge is larger on downstream developing sleeve than the other, normally. Therefore, the development particularly property is stabilized since the properties of the developing sleeves are optimum against the variation of the ambient condition between the high temperature and high humidity and normal temperature low humidity.

Within the hollow of the upstream development sleeve 20, a magnet having five magnetic poles and a magnetic field pattern, shown in FIG. 10 and Table 13, is stationarily disposed.

TABLE 13

| | MAG. FORCE (G) | ANGLE (deg.) | HALF-PEAK WIDTH (deg.) |
|---|---|---|---|
| N1 | 900 | 0 | 38 |
| N2 | 1000 | 90 | 46 |
| S1 | 900 | 160 | |
| S2 | 500 | 270 | |

The upstream development sleeve 20 is rotated at the 125% of the peripheral velocity of the photoconductive drum 1. The toner particle layer on the upstream development sleeve 20 are regulated in thickness by a magnetic blade 20A. The distance S-Bgap between the upstream development sleeve 20 and magnetic blade 20A is 250 μm. The distance S-Dgap between the upstream development sleeve 20 and photoconductive drum 1 is 250 μm. In this embodiment, a latent image is developed by applying to the upstream development sleeve 20 the combination of a DC bias voltage of −550 V, and an AC bias voltage having the rectangular waveform shown in FIG. 7, a peak-to-peak voltage of 1,500 Vpp, and a frequency of 2.7 kHz, with the use of single-component magnetic developer, without placing the upstream development sleeve 20 in contact with the photoconductive drum 1. Thus, the development contrast, which causes toner particles to jump from the upstream development sleeve 20 to the photoconductive drum 1, is 350 V and the fog prevention contrast is 150 V.

The downstream development sleeve 30 is an aluminum (A2017) cylinder, that is, a nonmagnetic member, with a diameter of 20 mm. Its peripheral surface has been coated with film. Within the hollow of the downstream development sleeve 30, a magnet. Is stationarily disposed, which has four magnetic poles positioned in the pattern shown in FIG. 10, and the specifications (magnetic field pattern) of which are given in Table 14.

TABLE 14

| | MAG. FORCE (G) | ANGLE (deg.) | HALF-PEAK WIDTH (deg.) |
|---|---|---|---|
| N1 | 900 | 0 | 38 |
| N2 | 1000 | 110 | 46 |
| N3 | 500 | 240 | |

TABLE 14-continued

| | MAG. FORCE (G) | ANGLE (deg.) | HALF-PEAK WIDTH (deg.) |
|---|---|---|---|
| S1 | 850 | 60 | |
| S2 | 500 | 170 | |
| S3 | 600 | 300 | |

To the downstream development sleeve 30, a DC bias voltage of −550 V, and an AC voltage having the rectangular waveform shown in FIG. 7, a peak-to-peak voltage of 1,500 Vpp, and a frequency of 2.7 kHz, are applied in combination. The AC and DC voltages applied to the downstream development sleeve 30 are identical to those applied to the upstream development sleeve 20. Therefore, cost can be reduced by making a structural arrangement so that a single power source can be shared by the bias applying means for the upstream development sleeve 20 and bias applying means for the downstream development sleeve 30. Such an arrangement has a merit in that it reduces the space necessary for the power source. The downstream development sleeve 30 is rotated at the 125% of the peripheral velocity of the photoconductive drum 1.

The toner particle layer on the peripheral surface of the downstream development sleeve 30 is regulated in thickness by the upstream development sleeve 20. The distance d between the peripheral surfaces of the upstream development sleeve 20 and downstream development sleeve 30 is 600 μm.

The positioning of the magnetic poles of the magnets in the upstream development sleeve 20 and downstream development sleeve 30, and the specifications of the magnets, are given in Tables 13 and 7. In other words, the magnet in the upstream development sleeve 20 has five poles, whereas the magnet in the downstream development sleeve 30 has four pole. The reason why the magnet in the upstream development sleeve 20 was given five poles is as described before.

In this embodiment, the distance d is 600 μm (d=600 μm). The magnetic force of the magnetic pole N2 (A) of the magnet 20B placed in the upstream development sleeve 20 is 85 mT, and the magnetic force of the magnetic pole S1 (B) of the magnet 30B placed in the downstream development sleeve 30 is 80 mT. The magnetic pole A, and the magnetic pole N1 (C) of the magnet 30B, which is aligned with the plane connecting the axial lines of the magnet 30B and photoconductive drum 1, or is placed in the adjacencies of this plane, are identical in polarity. The magnetic pole B is different in polarity from the magnetic poles A and C.

The magnetic poles A and B are on the inward side of the developing apparatus 2 (side opposite to photoconductive drum 1), with respect to the plane connecting the rotational axes of the upstream development sleeve 20 and downstream development sleeve 30. Further, the angle θ in FIG. 15(*a*) is 10°.

In this embodiment, the relationship among the magnetic force [mT] of the magnetic pole A, magnetic force [mT] of the magnetic pole B, and distance d [μm] satisfies the following mathematic formula:

$$0.5 \geqq (85+80)/600 \geqq 0.2.$$

Therefore, the toner coat on the downstream development sleeve 30 remains stable.

Thus, according to this embodiment, it is possible to provide a small maintenance-free developing apparatus which uses single-component magnetic toner, and yet is capable of uniformly coating developer on the peripheral surface of the upstream developer bearing member so that an image of high quality, in particular, in terms of density, can be always produced, and is smaller in toner consumption. In other words, it is possible to provide a compact developing apparatus suitable for a high speed print-on-demand apparatus employing a distributed developing system. Further, it is possible to reduce the toner deterioration by reducing the amount by which toner particles remain stuck on the upstream developer bearing member during its rotation. Further, it is possible to use a coating method optimal, in terms of charge characteristic, for the toner in use, in order to control toner charge.

Embodiment 6

Next, the sixth embodiment of the present invention will be described. The structural arrangements in this embodiment similar to those in the fourth and fifth embodiments will be not described.

The developing apparatus in this embodiment is identical to that in the fifth embodiment.

The characteristic feature of this embodiment is that the present invention is applied to an image forming apparatus which reuses waste toner.

The toner which is reused in an image forming apparatus is basically the waste toner, that is, the toner which was recovered during the cleaning process, in other words, the toner which was not transferred, and remained on a developer bearing member. Therefore, it is inferior in the amount of triboelectrical charge, compared to the fresh toner; the amount of the triboelectrical charge it carries is extremely small. In other words, it contains a large amount of inversely charged components. Therefore, it scatters more easily. This embodiment is put together in consideration of the above described properties of the waste toner.

The magnetic poles of the upstream development sleeve and downstream development sleeve, and formula of the film coated on the peripheral surface of each developer bearing member in this embodiment is identical to that in the fifth embodiment.

The reuse toner, that is, the waste toner, sometimes contains paper dust and the like. Thus, when the waste toner is reused as in this embodiment, these foreign substances sometimes become stuck between the two development sleeves, blocking the gap between the two sleeves. In this embodiment, therefore, the distance d between the upstream development sleeve and downstream development sleeve is set to 800 μm, in order to prevent such a problem.

The image forming apparatus in this embodiment is a digital copying machine employing the image forming system, shown in FIG. 11, which is 500 mm/sec in process speed and produces 110 copies per minutes. It comprises a photoconductive drum 1 as a latent image bearing member, which is an amorphous silicon type photoconductive drum.

In this image forming apparatus, the peripheral surface of the photoconductive drum 1 is uniformly charged by a primary charger 3 to a potential level of −700 V.

Then, the uniformly charged peripheral surface of the photoconductive drum 1 is exposed to a beam 12 of image exposure light at a resolution of 600 psi. The exposure beam 12 is a laser beam which has a wavelength of 680 μm, and is modulated in pulse-width with image formation signals, and the source of which is a semiconductor laser. As a result, an electrostatic latent image is formed on the peripheral surface of the photoconductive drum 1.

Next, the latent image is normally developed into a visual image, that is, a toner image, by a developing apparatus 2. The developing apparatus in this embodiment uses single-component negative magnetic toner with a particle diameter of 8.0 μm, as developer, and a jumping developing method, for the following reason: In the case of the conventional two-component developer, the carrier must be added for every 10,000 copies. In other words, the use of the conventional two-component developer does not allow a developing apparatus to be free of maintenance, allowing therefore the merits of the toner recycling system to be only partially utilized. In comparison, in this embodiment, dry single-component magnetic toner, which has no limit in durability and is free of maintenance, is used. The development bias voltages for the upstream development sleeve 20 and downstream development sleeve 30 are both the combination of an AC bias voltage having a frequency of 2.400 Hz, a peak-to-peak voltage of 1,500 Vpp, and a duty ratio of 50%, and a DC voltage of +200 V. In this embodiment, the distance S-Bgap between the upstream development sleeve 20 and magnetic blade 20A is 250 μm, and the distances S-Dgap between the upstream development sleeve 20 and photoconductive drum 1, and between the downstream development sleeve 30 and photoconductive drum 1, are both 250 μm.

Thereafter, the above described toner image is charged by a post-charger 10 as a charging means; a total current of −200 μA is flowed. Then, it is transferred by a transfer charger 4 as a transferring means, onto a transfer medium as a recording medium being conveyed in the direction indicated by an arrow mark.

After the transfer of the toner image onto the transfer medium, the transfer medium is separated from the photoconductive drum 1 by a separation charger 5, and sent to a fixing apparatus 7, by which the tone image is fixed.

Meanwhile, the toner particles which remained on the photoconductive drum 1 after the image transfer are recovered (removed) from the photoconductive drum 1 by a cleaning apparatus 6 as a removing means, and are returned, as waste toner (reuse toner), to a developer hopper 9B through a conveyance pipe 8.

Within the conveyance pipe 8, a conveying member in the form of a screw is disposed. As this conveying member rotates, the reuse toner is conveyed toward the developer hopper 9B. After being conveyed to the developer hopper 9B by the conveying member in the conveyance pipe 8, it is placed in the developer hopper 9B, as shown in FIG. 11, to be reused. Further, a fresh supply of toner, which is separated from the reuse toner, is placed in the hopper 9A. Both toners are pulled inward of the hopper 9 by the magnetic rollers 24A and 24B, respectively, and as the magnetic rollers 24A and 24B rotate, the toners are conveyed into the developing apparatus 2. Incidentally, in this embodiment, the reuse toner and fresh toner are mixed within the developing apparatus. However, the hopper 9 may be provided with a mixing space, in which the reuse toner and fresh toner are mixed.

After being mixed in the developing apparatus 2, the mixed combination of the reuse and fresh toner is sent out to the upstream development sleeve 20 and downstream development sleeve 30 to be used for the development of the electrostatic latent image on the photoconductive drum 1. In this embodiment, the normal revolution of the magnetic roller 24A is twice per second, whereas the revolution of the magnetic roller 24B is varied at a predetermined ratio relative to the revolution of the magnetic roller 24A In this embodiment, a piezoelectric sensor (product of TDK Co., Ltd.) is placed in the developing apparatus 2. As the toner weight is removed from the piezoelectric sensor by the toner consumption, the signal from the piezoelectric sensor begins to oscillate. Then, a toner supply signal is outputted to rotate the magnetic rollers 24A and 24B. Normally, the magnetic roller 24B is rotated at the 10/90 of the revolution of the magnetic roller 24B (revolution of magnetic roller 24A: revolution of magnetic roller 24B=9:1).

In this embodiment, the aforementioned distance d is 800 μm (d=800 μm). The magnetic force of the magnetic pole N2 (A) of the magnet 20B placed in the upstream development sleeve 20 is 80 mT, and the magnetic force of the magnetic pole S1 (B) of the magnet 30B placed in the downstream development sleeve 30 is 75 mT. The magnetic pole A, and the magnetic pole N1 (C) of the magnet 30B, which is aligned with the plane connecting the axial lines of the magnet 30B and photoconductive drum 1, or is placed in the adjacencies of this plane, are identical in polarity. The magnetic pole B is different in polarity from the magnetic poles A and C.

The magnetic poles A and B are on the inward side of the developing apparatus 2 (side opposite to photoconductive drum 1), with respect to the plane connecting the rotational axes of the upstream development sleeve 20 and downstream development sleeve 30. Further, the angle θ in FIG. 15(*a*) is 10°.

In this embodiment, the relationship among the magnetic force [mT] of the magnetic pole A, magnetic force [mT] of the magnetic pole B, and distance d [μm] satisfies the following mathematic formula $$0.5 \geqq (80+75)/800 \geqq 0.2.$$

Therefore, the toner coat on the downstream development sleeve 30 remains stable.

Thus, according to this embodiment, it is possible to provide a small maintenance-free developing apparatus which uses single-component magnetic toner, is capable of reusing the waste toner, and yet is capable of uniformly coating developer on the peripheral surface of the upstream developer bearing member so that an image of high quality, in particular, in terms of density, can be always produced, and is smaller in toner consumption. In other words, it is possible to provide a compact developing apparatus suitable for a high speed print-on-demand apparatus employing a distributed developing system.

While the invention has been described with reference to the structures disclosed herein, it is not confined to the details set forth, and this application is intended to cover such modifications or changes as may come within the purposes of the improvements or the scope of the following claims.

What is claimed is:

1. A developing device comprising:

a developing container for containing magnetic toner;

first and second toner carrying members for carrying the toner in said developing container toward first and second developing zones to develop an electrostatic image on an image bearing member, respectively, by rotation thereof in a same rotational direction, a layer thickness of the toner carried on said second toner carrying member being regulated by said first toner carrying member;

a first magnetic member, provided in said first toner carrying member, for generating a magnetic field, said first magnetic member having a first magnetic pole disposed at a position so as to be substantially opposite to the image bearing member and a second magnetic pole disposed at a position so as to be substantially opposite to said second toner carrying member and having a polarity opposite to a polarity of said first magnetic pole; and a second magnetic member, provided in said second toner carrying member, for generating a magnetic field, said second magnetic member having a third magnetic pole disposed at a position so as to be substantially opposite to said first toner carrying member and having a polarity that is the same polarity as the polarity of said first magnetic pole, wherein magnetic flux densities A, B, and C of said first magnetic pole, said second magnetic pole, and said third magnetic pole, respectively satisfy:

$$|A|>|B|>|C|$$

where |A| is not less than 80 mT, and |B| and |C| are not less than 50 mT.

2. A device according to claim 1, wherein said second magnetic pole and said third magnetic pole are disposed at a side opposite from a side wherein the image bearing member is disposed, with respect to a line connecting a center of rotation of said first toner carrying member and a center of rotation of said second toner carrying member.

3. A device according to claim 1, wherein a distance d ($\mu$m) between said first toner carrying member and said second toner carrying member satisfies:

$$0.5 \geqq (B+C)/d \geqq 0.2.$$

4. A device according to claim 1, wherein during a developing operation, said first toner carrying member and said second toner carrying member are supplied with voltages, each of which is in the form of a DC voltage biased with an AC voltage.

5. A developing device comprising:

a developing container for containing magnetic toner;

first and second toner carrying members for carrying the toner in said developing container toward first and second developing zones to develop an electrostatic image on an image bearing member, respectively, by rotation thereof in a same rotational direction, a layer thickness of the toner carried on said second toner carrying member being regulated by said first toner carrying member;

a first magnetic member, provided in said first toner carrying member, for generating a magnetic field, said first magnetic member having a first magnetic pole disposed at a position so as to be substantially opposite to said second toner carrying member; and a second magnetic member, provided in said second toner carrying member, for generating a magnetic field, said second magnetic member having a second magnetic pole disposed at a position so as to be substantially opposite to said first toner carrying member and a third magnetic pole disposed at a position so as to be substantially opposite to the image bearing member and having a polarity that is the same polarity as a polarity of said first magnetic pole, wherein magnetic flux densities A (mT) and B (mT) of said first magnetic pole and said second magnetic pole, respectively, and a distance d ($\mu$m) between said first toner carrying member and said second toner carrying member satisfy:

$$0.5 \geqq (A+B)/d \geqq 0$$

$$1000 \geqq d \geqq 200.$$

6. A developing device according to claim 5, wherein a first line connecting a rotational center of said first toner carrying member and a rotational center of said second toner carrying member, a second line connecting the rotational center of said first toner carrying member and said first magnetic pole, a third line connecting the rotational center of said second toner carrying member and said second magnetic pole, are such that an angle formed between the first line and the second line and an angle formed between the first line and the third line is not less than 0 degrees and not more than 20 degrees.

7. A developing device according to claim 5, wherein during a developing operation, said first toner carrying member and said second toner carrying member are supplied with voltages, each of which is in the form of a DC voltage biased with an AC voltage.

8. A developing device comprising:

a developing container for containing magnetic toner;

first and second toner carrying members for carrying the toner in said developing container toward first and second developing zones to develop an electrostatic image on an image bearing member, respectively, by rotation thereof in a same rotational direction, a layer thickness of the toner carried on said second toner carrying member being regulated by said first toner carrying member;

a first magnetic member, provided in said first toner carrying member, for generating a magnetic field, said first magnetic member having a first magnetic pole disposed at a position so as to be substantially opposite to said second toner carrying member; and a second magnetic member, provided in said second toner carrying member, for generating a magnetic field, said second magnetic member having a second magnetic pole disposed at a position so as to be substantially opposite to said first toner carrying member and having a polarity opposite to a polarity of said first magnetic pole, wherein said first magnetic pole and said second magnetic pole are disposed at a side opposite from a side where the image bearing member is disposed, with respect to a first line connecting a rotational center of said first toner carrying member and a rotational center of said second toner carrying member, wherein a second line connecting the rotational center of said first toner carrying member and said first magnetic pole and a third line connecting the rotational center of said second toner carrying member and said second magnetic pole are such that an angle formed between the first line and the second line and an angle formed between the first line and the third line are not less than 0 degrees and not more than 20 degrees.

* * * * *

UNITED STATES PATENT AND TRADEMARK OFFICE

CERTIFICATE OF CORRECTION

PATENT NO. : 6,959,163 B2
DATED : October 25, 2005
INVENTOR(S) : Kazushige Nishiyama It is certified that error appears in the above-identified patent and that said Letters Patent is hereby corrected as shown below:

Title page,
Item [56], References Cited, FOREIGN PATENT DOCUMENTS,
"2-204084 9/1991" should read -- 3-20408 9/1991 --.
Item [57], ABSTRACT,
Line 13, "member fields" should read -- member --.

Drawings,
Sheet 13, Figure 16, "COARTING" (both occurrences) should read
-- COATING --.

Column 1,
Line 52, "above described" should read -- above-described --; and
Line 53, "visible" should read -- visible image --.

Column 2,
Line 12, "above described" should read -- above-described --; and
Line 62, "uses" should read -- use --.

Column 3,
Line 10, "above" should read -- above- --; and
Lines 26 and 29, "of" should be deleted.

Column 5,
Line 17, "tone" should read -- toner --.

Column 6,
Line 29, "studies" should read -- study --; and
Line 53, "are" should be deleted.

Column 7,
Line 2, "above described" should read -- above-described --.

Column 8,
Lines 9 and 24, "above described" should read -- above-described --.

Column 10,
Line 56, "above described" should read -- above-described --.

UNITED STATES PATENT AND TRADEMARK OFFICE

CERTIFICATE OF CORRECTION

PATENT NO. : 6,959,163 B2
DATED : October 25, 2005
INVENTOR(S) : Kazushige Nishiyama It is certified that error appears in the above-identified patent and that said Letters Patent is hereby corrected as shown below:

Column 12,
Line 45, “fo” should read -- of --; and
Line 50, “above” should read -- above- --.

Column 13,
Lines 15 and 41, “above described” should read -- above-described --.

Column 14,
Line 12, “system” should read -- system. --; and
Line 32, “a” should be deleted.

Column 15,
Line 20, “substituents,” should read -- substituent, --.

Column 17,
Line 36, “electroconductivi-” should read -- electroconductivity --;
Line 37, “ties” should be deleted; and
Line 48, “In” should read -- in --.

Column 18,
Line 15, “20A” should read -- 20A. --.

Column 19,
Line 46, “above” should read -- above- --.

Column 20,
Line 28, “above described” should read -- above-described --; and
Line 37, “tone” should read -- toner --.

Column 22,
Line 3, “toner. Is” should read -- toner is --.

Column 26,
Table 10, Column 110 mT, “NG” should read -- NG
- NG
NG NG --.

Column 28,
Line 31, “above described” should read -- above-described --.

UNITED STATES PATENT AND TRADEMARK OFFICE

CERTIFICATE OF CORRECTION

PATENT NO. : 6,959,163 B2
DATED : October 25, 2005
INVENTOR(S) : Kazushige Nishiyama It is certified that error appears in the above-identified patent and that said Letters Patent is hereby corrected as shown below:

Column 30,
Line 62, “above described” should read -- above-described --.

Column 31,
Lines 27 and 53, “above described” should read -- above-described --; and
Line 63, “tone” should read -- toner --.

Column 32,
Line 15, “apparatus” should read -- apparatus of --; and
Line 60, “in” should read -- is --.

Column 33,
Line 41, “substituents,” should read -- substituent, --.

Column 36,
Line 55, “magnet. Is” should read -- magnet is --.

Column 37,
Line 37, “pole.” should read -- poles. --.

Column 38,
Line 32, “above” should read -- above- --.

Column 39,
Line 13, “2.400 Hz” should read -- 2,400 Hz, --;
Line 22, “above described” should read -- above-described --;
Line 31, “tone” should read -- toner --; and
Line 62, “24A” should read -- 24A. --.

Column 14,
Line 15, “as the” should read -- as to --.

Column 15,
Line 11, “According,” should read -- Accordingly, --; and
Line 20, “form” should read -- from --.

UNITED STATES PATENT AND TRADEMARK OFFICE

CERTIFICATE OF CORRECTION

PATENT NO. : 6,959,163 B2
DATED : October 25, 2005
INVENTOR(S) : Kazushige Nishiyama It is certified that error appears in the above-identified patent and that said Letters Patent is hereby corrected as shown below:

Column 18,
Line 6, "FIG. 22" should read -- FIGS. 22(a), 22(b), 22(c), and 22(d) --;
Line 7, "is" should read -- are --; and
Line 12, "FIG. 23 is" should read -- FIGS. 23(a) and 23(b) are --.

Column 19,
Line 3, "lager" should read -- larger --.

Signed and Sealed this

Eighteenth Day of April, 2006

JON W. DUDAS
*Director of the United States Patent and Trademark Office*